US011634196B2

(12) United States Patent
Begin et al.

(10) Patent No.: US 11,634,196 B2
(45) Date of Patent: Apr. 25, 2023

(54) STRADDLE SEAT ASSEMBLY

(71) Applicant: BOMBARDIER RECREATIONAL PRODUCTS INC., Valcourt (CA)

(72) Inventors: Carl Begin, Sherbrooke (CA); Kim Ross, Sherbrooke (CA); Simon Baldachino, Bromont (CA); Richard Lefebvre, Shefford (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 115 days.

(21) Appl. No.: 17/164,216

(22) Filed: Feb. 1, 2021

(65) Prior Publication Data

US 2021/0237832 A1 Aug. 5, 2021

Related U.S. Application Data

(60) Provisional application No. 62/968,835, filed on Jan. 31, 2020.

(51) Int. Cl.
*B63B 34/10* (2020.01)

(52) U.S. Cl.
CPC ..... *B63B 34/10* (2020.02)

(58) Field of Classification Search
CPC ..... B63B 34/10
See application file for complete search history.

(56) References Cited

U.S. PATENT DOCUMENTS 4,466,660 A 8/1984 Mabie
4,563,038 A 1/1986 Hirose
4,691,963 A 9/1987 Mikuniya et al.
5,320,059 A 6/1994 Ikeda
5,367,978 A 11/1994 Mardikian
5,441,330 A 8/1995 Rojas
5,501,168 A 3/1996 Zachary
5,533,783 A 7/1996 Harms et al.
5,544,937 A 8/1996 Hanagan
5,570,654 A 11/1996 Rood
5,915,329 A 6/1999 Watkins et al.
5,964,172 A 10/1999 Ikeda
6,041,732 A 3/2000 Ikeda
6,145,458 A * 11/2000 Hattori ..... B63B 34/10 114/55.57
6,422,648 B1 7/2002 Hanagan
6,491,124 B1 12/2002 Thompson et al.
6,761,401 B1 * 7/2004 McGlynn ..... B62J 1/12 297/211
6,918,348 B2 7/2005 Matsuda et al.
6,994,396 B2 * 2/2006 Burleson ..... B62J 1/12 297/215.11

(Continued)

*Primary Examiner* — S. Joseph Morano
*Assistant Examiner* — Jovon E Hayes
(74) *Attorney, Agent, or Firm* — BCF LLP

(57) ABSTRACT

A straddle seat assembly having a backrest and a straddle seat is disclosed. The straddle seat has a base structure that has an upper surface to which a resiliently deformable top portion is connected. The resiliently deformable top portion covers at least partially the upper surface. The backrest is selectively connected to the resiliently deformable top portion at either one of at least two positions along a length of the straddle seat such that deformation of the top portions permits movement of the backrest. A personal watercraft having the straddle seat assembly is also disclosed.

20 Claims, 21 Drawing Sheets

(56) References Cited

U.S. PATENT DOCUMENTS

| | | | | |
|---|---|---|---|---|
| 7,124,703 | B2 | 10/2006 | Simard et al. | |
| 7,571,692 | B2 * | 8/2009 | Kreger | B63B 34/10 114/55.57 |
| 8,037,835 | B2 * | 10/2011 | Miura | B63B 25/002 114/55.57 |
| 8,146,524 | B1 | 4/2012 | Cote et al. | |
| 8,261,683 | B2 | 9/2012 | Knoblett et al. | |
| 8,474,389 | B2 * | 7/2013 | Otsuka | B63B 29/04 114/55.57 |
| 9,561,830 | B2 * | 2/2017 | Grondin | B62J 1/12 |
| 2002/0073910 | A1 | 6/2002 | Yamada et al. | |
| 2014/0084644 | A1 * | 3/2014 | Grondin | B62J 1/12 297/215.12 |
| 2017/0259867 | A1 * | 9/2017 | Dery St-Cyr | B62K 5/027 |

* cited by examiner

STRADDLE SEAT ASSEMBLY

CROSS-REFERENCE TO RELATED APPLICATION

The present application claims priority to U.S. Provisional Patent Application No. 62/968,835, filed Jan. 31, 2020 entitled "Straddle Seat Assembly", which is incorporated by reference herein in its entirety.

FIELD OF THE TECHNOLOGY

The present technology relates to straddle seat assemblies, more specifically straddle seat assemblies having an adjustable backrest.

BACKGROUND

Straddle seats of conventional personal watercraft generally include backrests. Backrests, in part, provide lower back support while also preventing their operator from sliding rearwards on the personal watercraft upon forward acceleration.

Personal watercraft typically have straddle seats that have backrests integrally formed with the main portion of the straddle seat. This implies that the straddle seat and the backrest are not adjustable to accommodate various riding conditions. In some instances, such as during high speed operation, the operator may prefer to be positioned in a forward position, close to the personal watercraft's handlebar. In other instances, such as during long touring rides, the operator may prefer to sit in a more rearward, relaxed, position. In addition, the straddle seat and the backrest are not adjustable to accommodate operators of various sizes. Indeed, a tall operator may feel comfortable, whereas a shorter operator would not or vice-versa for a given straddle seat.

Adjustable backrests for straddle seats are known, such as in motorcycles for example. These backrests are typically rigidly mounted to their vehicles via brackets or the like. This rigid mounting is suitable in vehicles, such as the aforementioned motorcycles, that have a suspension. However, most personal watercraft do not have a suspension to absorb the shocks between the hull and the waves, rather it is the seat itself that serves to dampen shocks. As such, a rigidly mounted adjustable backrest could be uncomfortable since a rigidly mounted backrest will not move with the seat surface, and the driver or passenger sitting thereon, when the seat is compressed.

It would therefore be desirable to have a straddle seat assembly that provides the convenience of accommodating various types of rides and various types of bodies that is suitable for use in a personal watercraft.

SUMMARY

It is an object of the present technology to ameliorate at least some of the inconveniences present in the prior art.

According to one aspect of the present technology, there is provided a straddle seat assembly. The straddle seat assembly has a backrest and a straddle seat. The straddle seat has a base structure that has an upper surface. A resiliently deformable top portion is connected to and covers, at least partially, the upper surface of the base structure. The backrest is selectively connected to the resiliently deformable top portion at either one of at least two positions along a length of the straddle seat such that deformation of the top portion permits movement of the backrest.

In some embodiments, one of the top portion and the backrest has at least two longitudinally spaced first connector portions. Each of the at least two first connector portions define a corresponding one of the at least two positions. An other one of the top portion and the backrest has at least one second connector portion. The at least one second connector portion is connectable to the at least two first connector portions.

In some embodiments, the at least two first connector portions is at least two longitudinally spaced apertures that are defined in the one of the top portion and the backrest. The at least one second connector portion is at least one connection member. The at least one connection member is selectively received in one of the at least two longitudinally spaced apertures that correspond to a desired one of the at least two positions.

In some embodiments, the top portions defines the at least two apertures and the backrest has the at least one connection member.

In some embodiments, the backrest has a backrest portion and the at least one connection member extends from a bottom of the backrest portion.

In some embodiments, the top portion defines the at least two first connector portions and the backrest has the at least one second connector portion.

In some embodiments, the top portion of the straddle seat includes at least one strap that extends generally longitudinally and defines the at least two first connector portions.

In some embodiments, the at least two first connector portions is at least two longitudinally spaced apertures that are defined in the at least one strap. The backrest has the at least one second connector portion. The at least one second connector portion is at least one connection member; and the at least one connection member is selectively received in one of the at least two longitudinally spaced apertures that correspond to a desired one of the at least two positions.

In some embodiments, the at least one strap has a forward portion that is connected to the base.

In some embodiments, the top portion of the straddle seat includes a compressible layer that is connected to and covers at least partially the upper surface of the base structure. The at least one strap extends over at least a portion of the compressible layer.

In some embodiments, a portion of the at least one strap extends in a region of the straddle seat that is adapted for receiving a thigh of a person that is sitting on the straddle seat.

In some embodiments, the at least one strap is two laterally spaced straps; and the at least one second connector portion is two laterally spaced second connector portions.

In some embodiments, the two laterally spaced straps are connected to each other by an intermediate strap portion that extends laterally. The intermediate strap portion is disposed laterally between the two straps.

In some embodiments, the straddle seat assembly further has at least two eyelets. Each of the at least two eyelets is disposed in a corresponding one of the at least two longitudinally spaced apertures.

In some embodiments, the top portion of the straddle seat includes a compressible layer that is connected to and covers at least partially the upper surface of the base structure. The at least one strap extends over at least a portion of the compressible layer. The straddle seat also has at least one pocket defined in the compressible layer, and the at least two longitudinally spaced apertures are disposed above the at least one pocket.

In some embodiments, the top portion of straddle seat further includes a cover that covers the compressible layer. The compressible layer is between the base structure and the cover; and the at least one strap is between the compressible layer and the cover.

In some embodiments, the cover defines at least one cover aperture that surrounds the at least two longitudinally spaced apertures in the at least one strap. The top portion of the straddle seat assembly further includes at least one gasket that surrounds the at least one cover aperture and the at least two longitudinally spaced apertures in the at least one strap. The at least one gasket is disposed between the cover and the at least one strap.

In some embodiments, the straddle seat assembly further has a rear panel that is connected to the straddle seat; and a latch that selectively connects the backrest to the rear panel.

In some embodiments, the backrest defines a longitudinal slot in an underside thereof. The rear panel defines a recess, and the latch has a first portion that is slidably received in the slot and a second portion that is selectively received in the recess.

In some embodiments, the at least one second connector portion is at least one hook.

In some embodiments, the straddle seat has a rear portion and a front portion. The front portion extends upwardly and forwardly from the rear portion. The front portion has a generally hourglass shape, and the hourglass shape has a narrowing. The front portion has a pair of lateral wings. The straddle seat also has two side portions that extend downwardly. The pair of lateral wings extend laterally outwardly above at least part of the two side portions. The pair of lateral wings is adapted to cover at least in part knees and thighs of a rider.

In some embodiments, the top portion of the straddle seat includes a compressible layer that is connected to and covers at least partially the upper surface of the base structure. The compressible layer is made of foam.

In some embodiments, the top portion of the straddle seat includes a compressible layer that is connected to and covers at least partially the upper surface of the base structure. The cover covers the compressible layer; and a layer of waterproof material is disposed between the cover and the compressible layer.

According to another aspect of the present technology, there is provided a personal watercraft having a hull that has a bow and a stern, and a deck that is disposed on the hull. The deck has a pair of footrests, and a pedestal that is disposed between the footrests. The personal watercraft also includes a straddle seat assembly according to any one of the embodiments that are mentioned above.

For purposes of this application, terms related to spatial orientation such as forwardly, rearward, upwardly, downwardly, left, and right, are as they would normally be understood by an operator of the vehicle sitting thereon in a normal riding position. Terms related to spatial orientation when describing or referring to components or sub-assemblies of the vehicle, separately from the vehicle, such as a deck or hull for example, should be understood as they would be understood when these components or sub-assemblies are mounted to the vehicle, unless specified otherwise in this application. The term "straddle seat" refers to a seat on which a person normally sits astride and can also be referred to as a "saddle seat". The term "motor" can refer to any component capable of driving the motion of a watercraft, which includes, but is not limited to, an internal combustion engine or an electric motor.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of embodiments of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

The present detailed description is intended to be a description of illustrative examples of the present technology.

The present technology relates to a straddle seat assembly 500 having a straddle seat 502 and a backrest 504 that can be connected to the straddle seat 502 at different positions along the length of the straddle seat 502. The straddle seat assembly 500 will be described in association with a personal watercraft 50. However, it is contemplated that the straddle seat assembly 500 and features thereof could be used with other types of vehicles provided with straddles seats, such as, but not limited to, motorcycles, all-terrain vehicles (ATVs), and snowmobiles.

Figure 1:
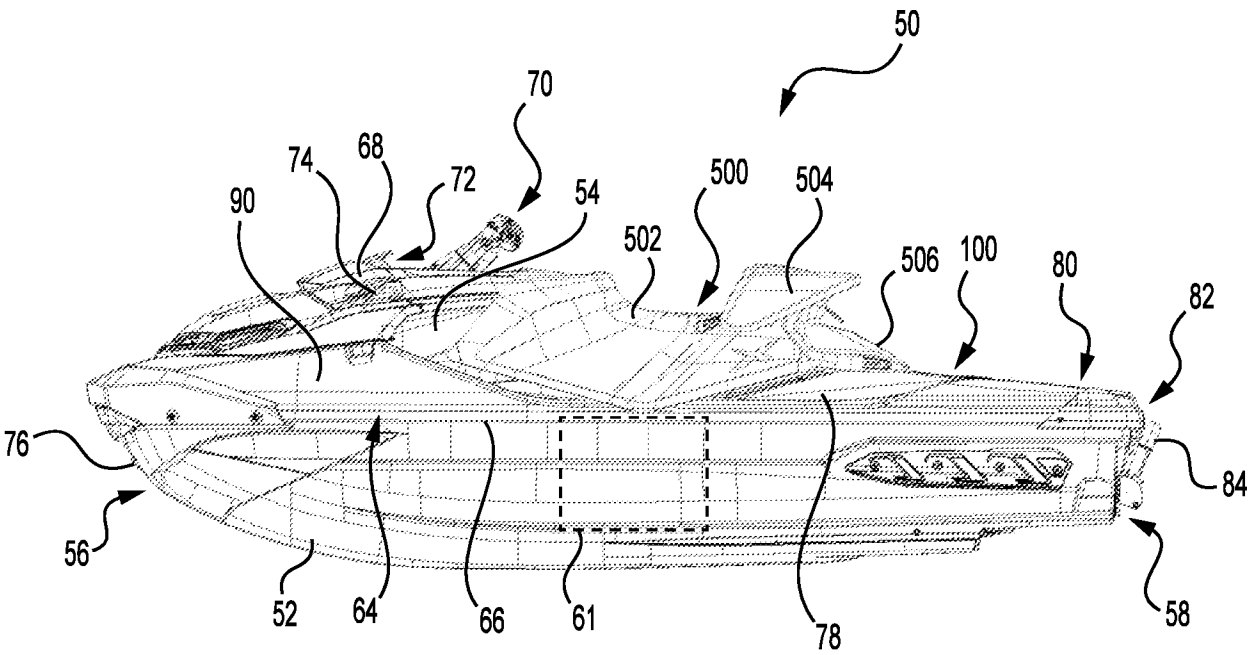
FIG. 1 is a left side elevation view of a personal watercraft.
Figure 2:
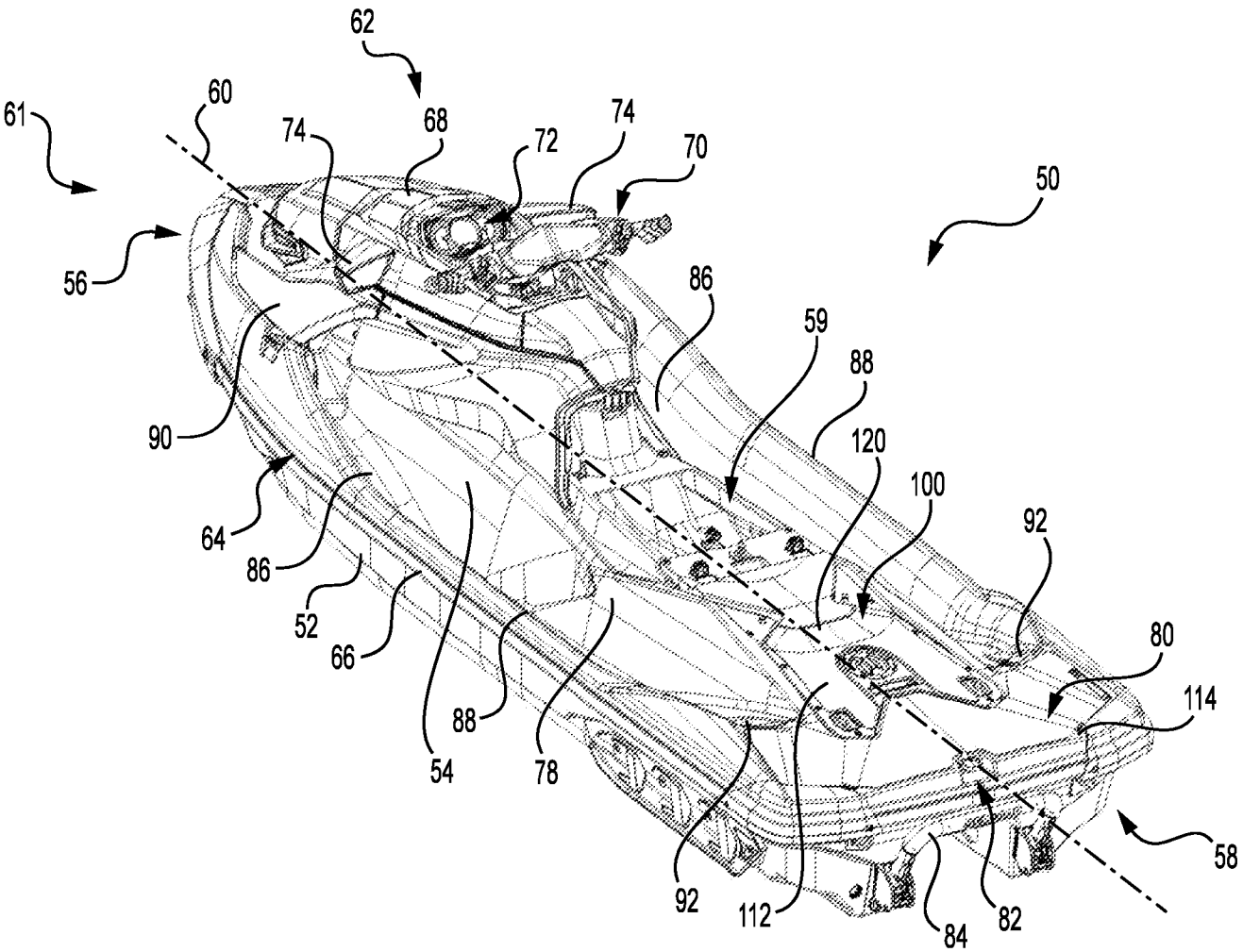
FIG. 2 is a top, left, rear side perspective view of the personal watercraft of FIG. 1 with a straddle seat assembly removed from the personal watercraft.

Referring to FIGS. 1 and 2, an embodiment of the personal watercraft 50 will be described. The personal watercraft 50 has a hull 52 and a deck 54. The hull 52 and the deck 54 are made of fiberglass composite material. It is contemplated that other suitable materials could be used to make the hull 52 and the deck 54. The hull 52 buoyantly supports the watercraft 50 in the water. The hull 52 has a bow 56 and a stern 58. A longitudinal centerline 60 (shown in FIG. 2) extends between the bow 56 and the stern 58 and splits the deck 54 into a left longitudinal side 61 and a right longitudinal side 62. For the purpose of the following description, the components that are qualified as "left" or "right" are positioned on the corresponding left longitudinal side 61 and right longitudinal side 62 of the deck 54, unless mentioned otherwise.

The deck 54 is designed to accommodate an operator referred to as driver. The hull 52 and the deck 54 are joined together at a seam 64. The seam 64 comprises a bond line formed by an adhesive. Other known joining methods could be used to engage the parts together, including but not limited to thermal fusion, molding or fasteners such as rivets, bolts or screws. A bumper 66 generally covers the seam 64. The bumper 66 helps to prevent damage to the outer surface of the watercraft 50 when the watercraft 50 is docked, for example. The bumper 66 extends around the bow 56 and the stern 58, as shown, or could extend around any portion or the entire seam 64.

The space between the hull 52 and the deck 54 forms a volume commonly referred to as the motor compartment 59 (FIG. 2). The motor compartment 59 accommodates various elements that are required or desirable in the personal watercraft 50 such as a motor 61 (FIG. 1), in the form of an internal combustion engine, a fuel tank, an air intake system, an electrical system, and an exhaust system (not shown). The motor drives a water jet propulsion system of the personal watercraft 50, although other types of propulsion systems are contemplated in other embodiments.

Still referring to FIGS. 1 and 2, the deck 54 has a hood 68, a helm assembly 70 rearward of the hood 68 and an instrument cluster 72 forward of the helm assembly 70. A hinge (not shown) is attached between the hood 68 and the deck 54 to allow the hood 68 to move to an open position to provide access to a storage bin (not shown). Left and right rear view mirrors 74 (best seen in FIG. 2) are positioned on corresponding left and right sides of the hood 68 to allow the driver to see behind the watercraft 50. A hook 76 is located at the bow 56 of the hull 52. The hook 76 is used to attach the watercraft 50 to a dock when the watercraft 50 is not in use or to attach to a winch when loading the watercraft 50 on a trailer, for example.

The deck 54 has a centrally positioned straddle seat assembly 500 supported on top of a pedestal 78 formed by the deck 54. Accordingly, the straddle seat assembly 500 and the pedestal 78 are aligned with the longitudinal centerline 60. The straddle seat assembly 500 accommodates one driver in a straddling position. It is contemplated that in other embodiments, the straddle seat assembly 500 could accommodate one or more passengers in addition to the driver. The deck 54 forms footwells 86 on either side of the pedestal 78 that provide support for the driver's feet. A pair of generally upwardly extending walls located on either side of the deck 54, known as gunwales or gunnels 88, are provided next to the footwells 86. The gunnels 88 help to reduce the entry of water in the footwells 86 of the watercraft 50, provide lateral support for the driver's feet, and also provide buoyancy when turning the watercraft 50, since the personal watercraft 50 can roll slightly when turning. Towards the bow 56, fairings 90 extend between the gunnels 88 and the hood 60 and further help reduce the entry of water in the footwells 86. Towards the stern 58, the gunnels 88 extend inwardly to act as heel rests 92. It is contemplated that the heel rests 92 could also be formed separately from the gunnels 88. The deck 54 includes a reboarding platform 80 at a rear thereof allowing a rider to easily reboard the watercraft 50 from the water. A retractable ladder or reboarding step 84 is affixed to the stern 58 of the personal watercraft 50 to facilitate boarding of the personal watercraft 50 from the water onto the reboarding platform 80.

Still referring to FIGS. 1 and 2, the personal watercraft 50 has a rear platform 100. The rear platform 100 is laterally centered on the deck 54, i.e. laterally centered along the longitudinal centerline 60. The rear platform 100 extends forward from the reboarding platform 80 to the pedestal 78. It can be seen in FIG. 1 that the generally planar surface formed by the rear platform 100 and the reboarding platform 80 extends upwardly and forwardly from the rear end 82 of the deck 54. The rear platform 100 has a padding material 112 along the top surface 108 of the rear platform 110 and a top face 114 of the reboarding platform 80. The padding material 112 is a foam mat having a texturized surface. Other types and configurations of padding material could be used. The padding material 112 could provide more comfort and traction to a rider boarding the watercraft 50 from the water and/or to a rider lying down on the rear platform 100. The rear platform 100 includes a deck panel 120. The straddle seat assembly 500 connects to the pedestal 78 thanks to seat connectors such as the ones disclosed in U.S. Pat. No. 10,214,270, issued Feb. 26, 2019, the entirety of which is incorporated herein by reference. It is contemplated that the straddle seat assembly 500 could be connected to the pedestal 78 by other connecting systems.

Referring now to FIGS. 3 to 10, the straddle seat assembly 500 will be described in more detail.

Figure 3:
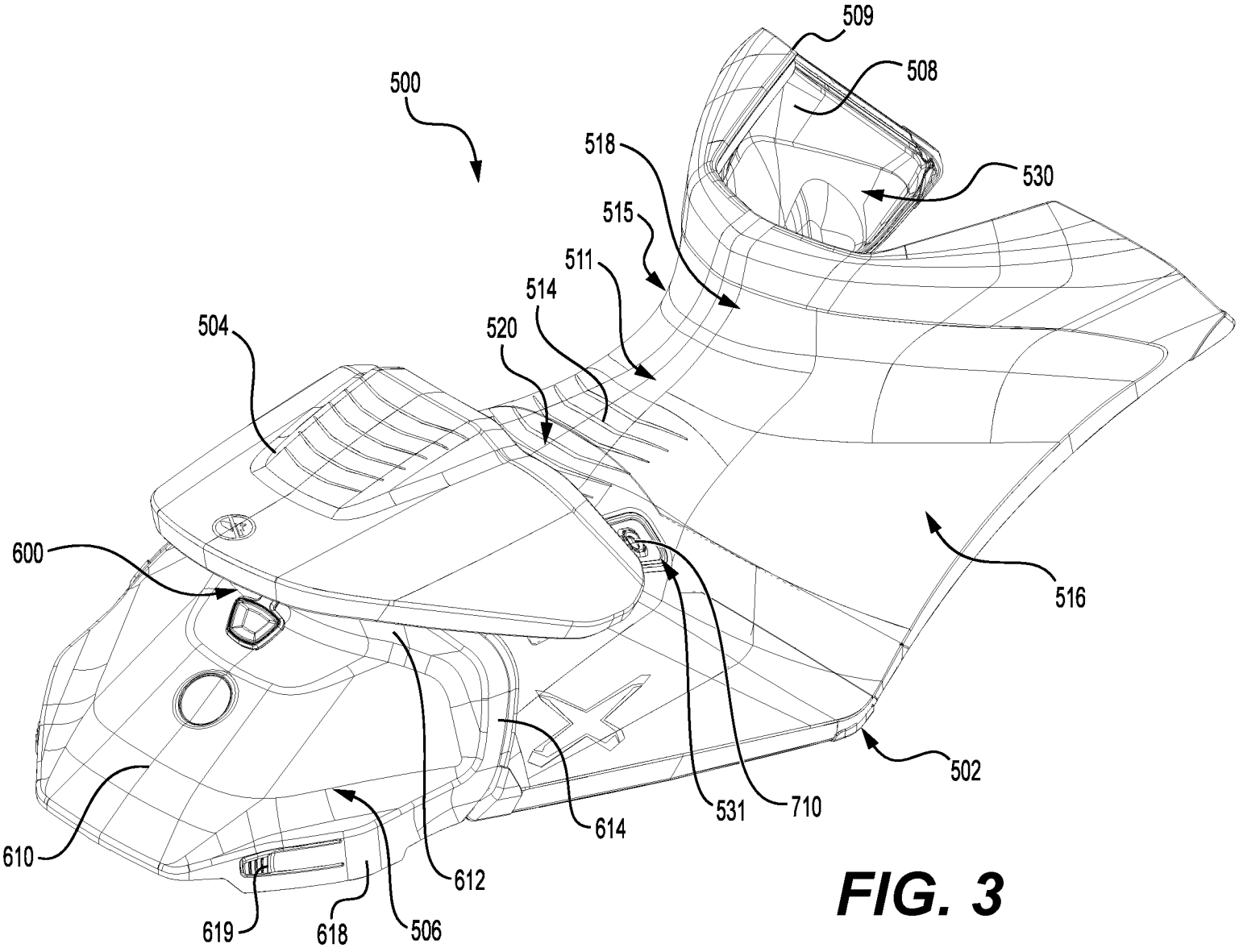
FIG. 3 is a top, right, rear side perspective view of a straddle seat assembly of the personal watercraft of FIG. 1.
Figure 19:
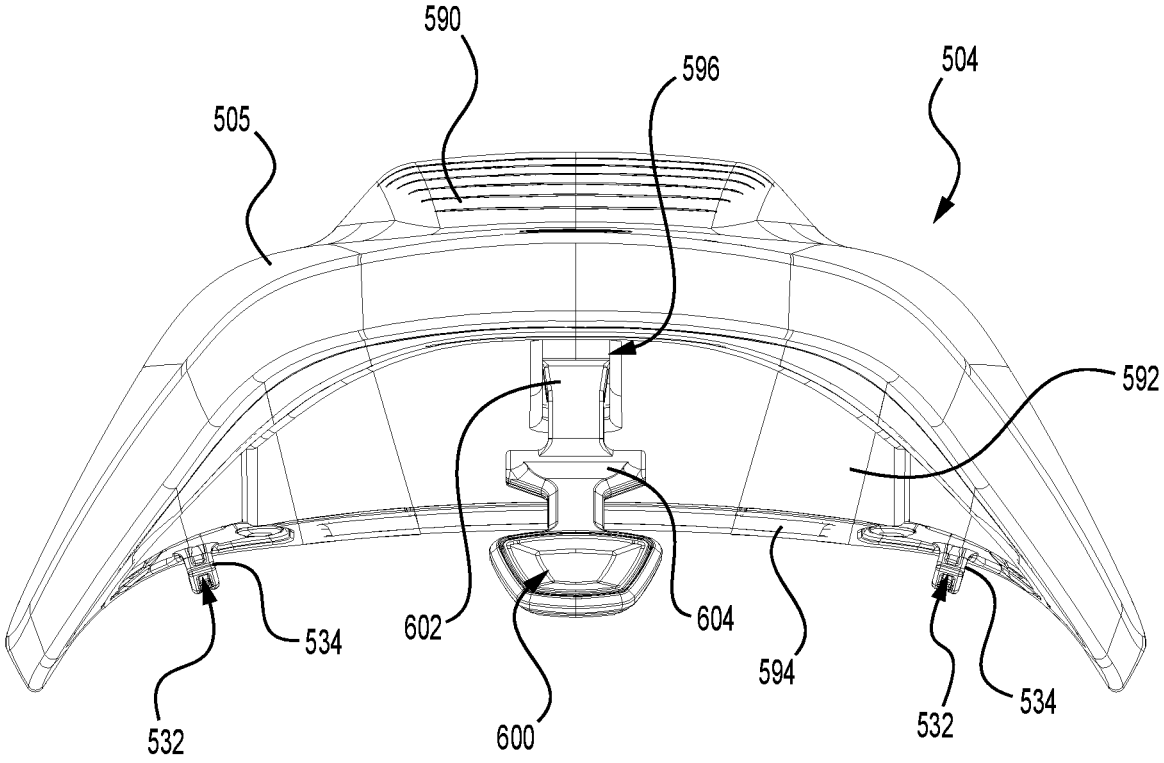
FIG. 19 is a rear elevation view of the backrest of FIG. 18.
Figure 20:
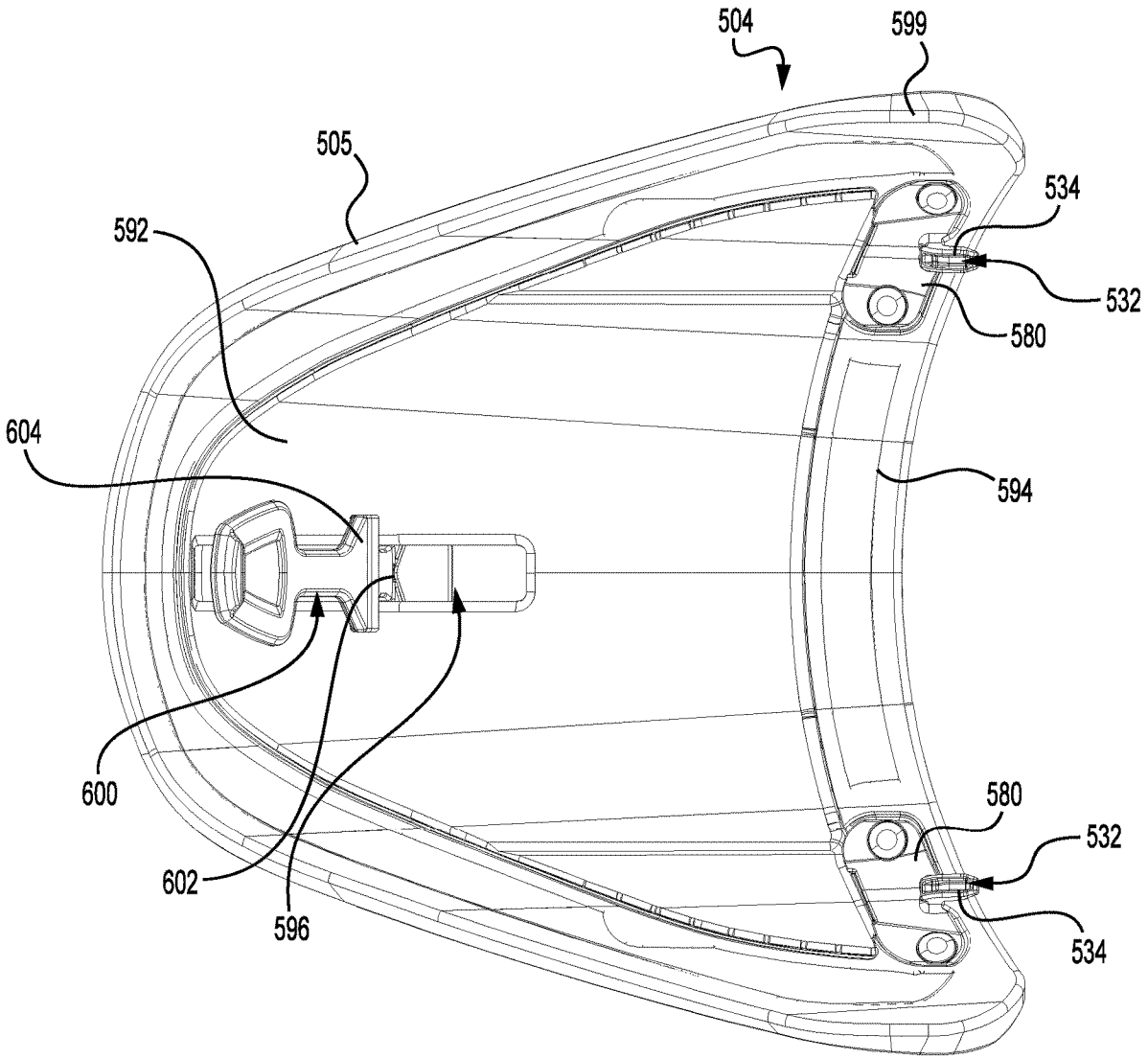
FIG. 20 is a bottom plan view of the backrest of FIG. 18.
Figure 21:
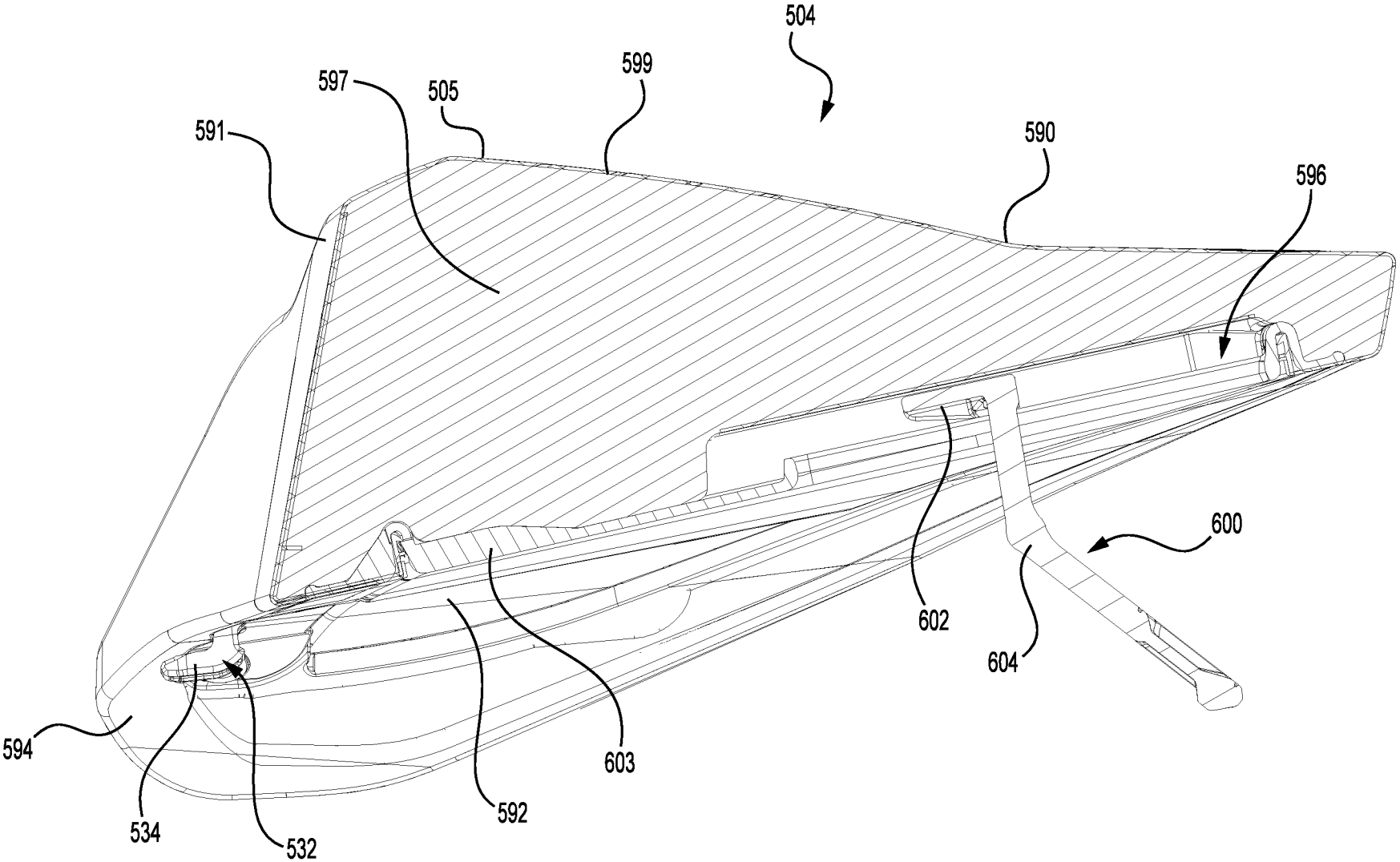
FIG. 21 is a cross-sectional view of the backrest of FIG. 18 taken through line 21-21 of FIG. 18.

Referring to FIG. 3, the straddle seat assembly 500 has the straddle seat 502, the backrest 504 and a rear panel 506. The position of the backrest 504 is longitudinally adjustable along the straddle seat 502. The backrest 504 selectively connects to a resiliently deformable top portion 511 of the straddle seat 502 at one of six longitudinally spaced positions thanks to connector portions 531 and connector portions 532 (FIGS. 19 to 21). It is contemplated that there could be more or less than six longitudinally spaced positions. Since the backrest 504 is directly connected to the resiliently deformable top portion 511, the backrest 504 moves with the resiliently deformable top portion 511, and the driver sitting thereon, when the resiliently deformable top portion 511 is resiliently deformed. In addition, it will be appreciated that the backrest 504 can also move when forces are applied to it by resiliently deforming the resiliently deformable top portion 511.

The resiliently deformable top portion 511 deforms considerably to cushion the driver. For example, when the watercraft 50, supporting the driver on the straddle seat assembly 500 and travelling in a forward direction, encounters a wave at or along the underside of the bow 56, the resiliently deformable top portion 511 compresses and cushions the driver. The backrest 504 moves with the driver sitting on top of the resiliently deformable top portion 511, thereby improving riding experience for the driver.

In the present embodiment, as shown in FIGS. 11 to 14, the connector portions 531 are six longitudinally spaced pairs of apertures 710, 720, 730, 740, 750, 760. It is contemplated that more or less pairs of apertures 710, 720, 730, 740, 750, 760 could be provided. In some embodiments, the connector portions 531 could be a single row or three or more rows of at least two longitudinally spaced apertures, rather than pairs of longitudinally spaced apertures. Best seen in FIG. 11, a first, forwardmost, position is defined by the laterally spaced and longitudinally aligned left and right apertures 710. A second position is defined by the laterally spaced and longitudinally aligned left and right apertures 720. A third position is defined by the laterally spaced and longitudinally aligned left and right apertures 730. A fourth position is defined by the laterally spaced and longitudinally aligned left and right apertures 740. A fifth position is defined by the laterally spaced and longitudinally aligned left and right apertures 750. A sixth, rearmost, position is defined by the laterally spaced and longitudinally aligned left and right apertures 760. As can be seen, the first, second, third, fourth, fifth and sixth positions are longitudinally spaced. The apertures 710, 720, 730, 740, 750, 760 are defined in the resiliently deformable top portion 511. The longitudinal rows of left and right apertures 710, 720, 730, 740, 750, 760 are parallel.

Referring to FIGS. 20 and 21, the connector portions 532 are left and right connection members 534 of the backrest 504 that are adapted to be respectively received into any one of the pairs of apertures 710, 720, 730, 740, 750, 760. In the present embodiment, the left and right connection members 534 are hooks 534. It is however contemplated that in other embodiments, the left and right connection members 534 could be shaped differently.

In alternative embodiments, it is contemplated that the backrest 504 could have the multiple longitudinally spaced connector portions 531 and that the straddle seat 502 could have one or more connector portions 532. It is also contemplated that the backrest 504 could have multiple longitudinally spaced connector portions 531 or 532 and that the straddle seat 502 could also have multiple longitudinally spaced connector portions 532 or 531 respectively. It is also contemplated that the connector portions 531 could be connection members similar to the connection members 534 and that the connector portions 532 could be apertures. It is also contemplated that the connector portions 531, 532 could be different portions of touch fasteners, such as hook-and-loop fasteners and the like, or of interlocking components that cooperate to retain the backrest 504 at different positions along the straddle seat 502.

Figure 7:
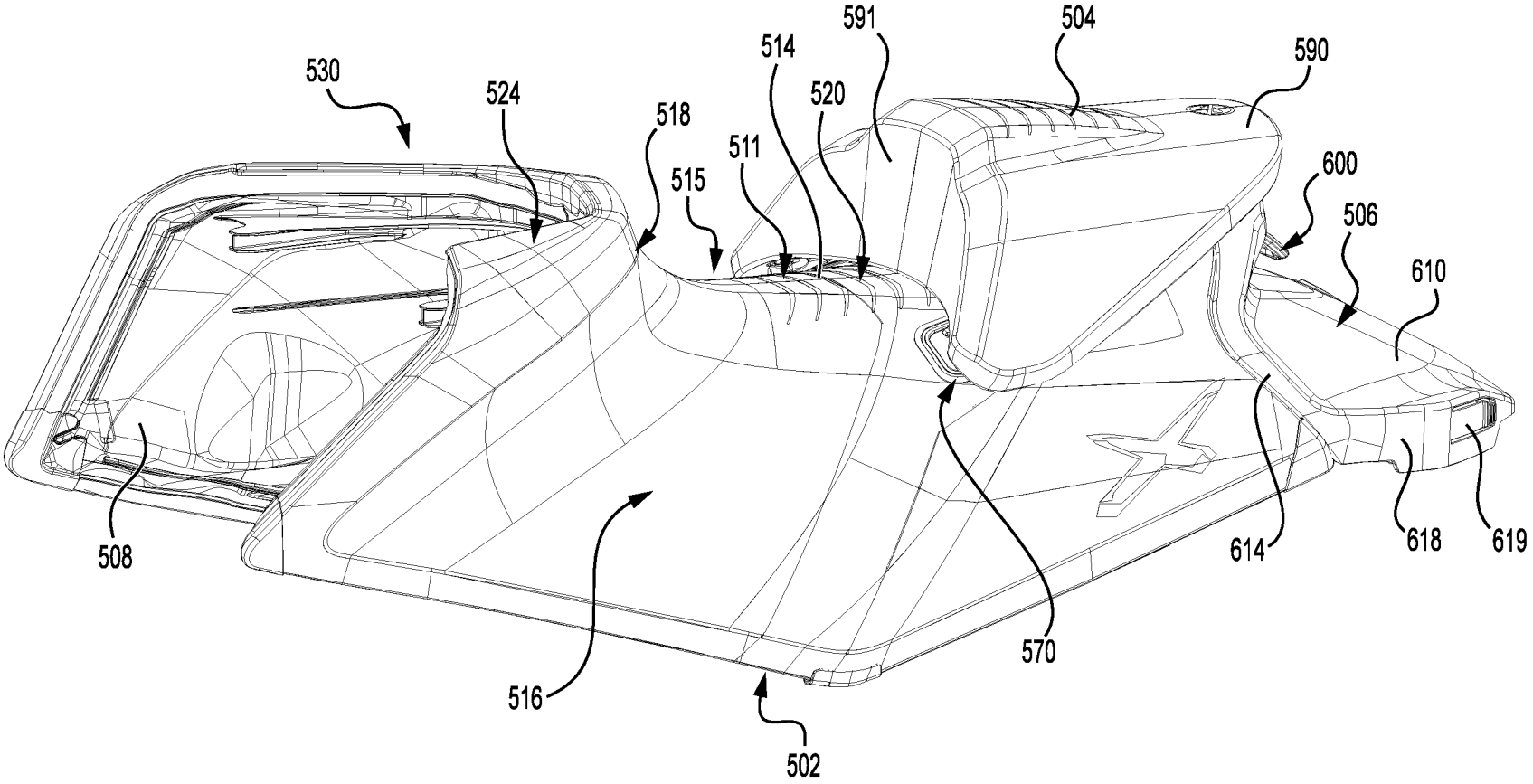
FIG. 7 is a top, front, left side perspective view of the straddle seat assembly of FIG. 3, with a backrest being at its most forward position.
Figure 8:
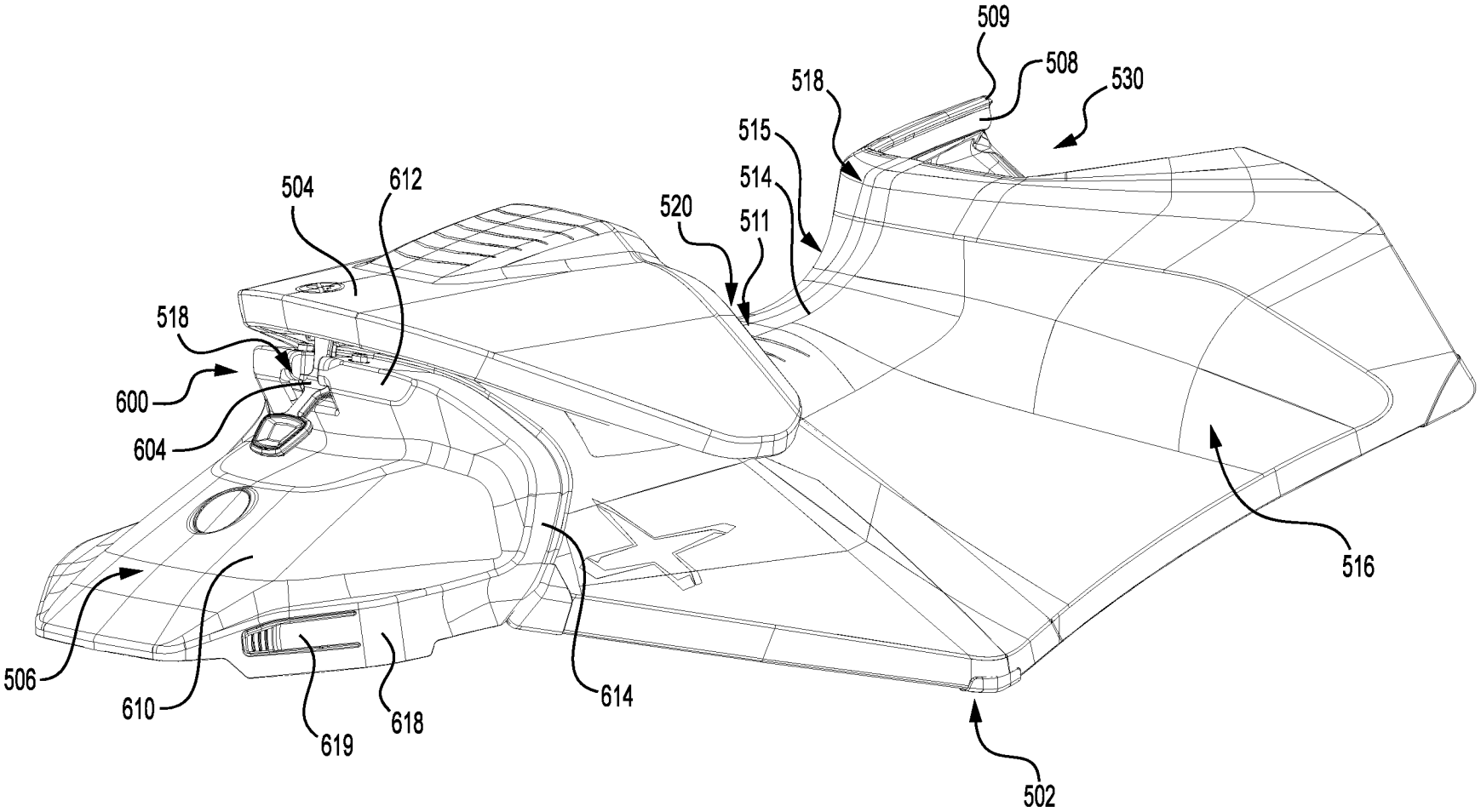
FIG. 8 is a top, rear, right side perspective view of the straddle seat assembly of FIG. 7.
Figure 9:
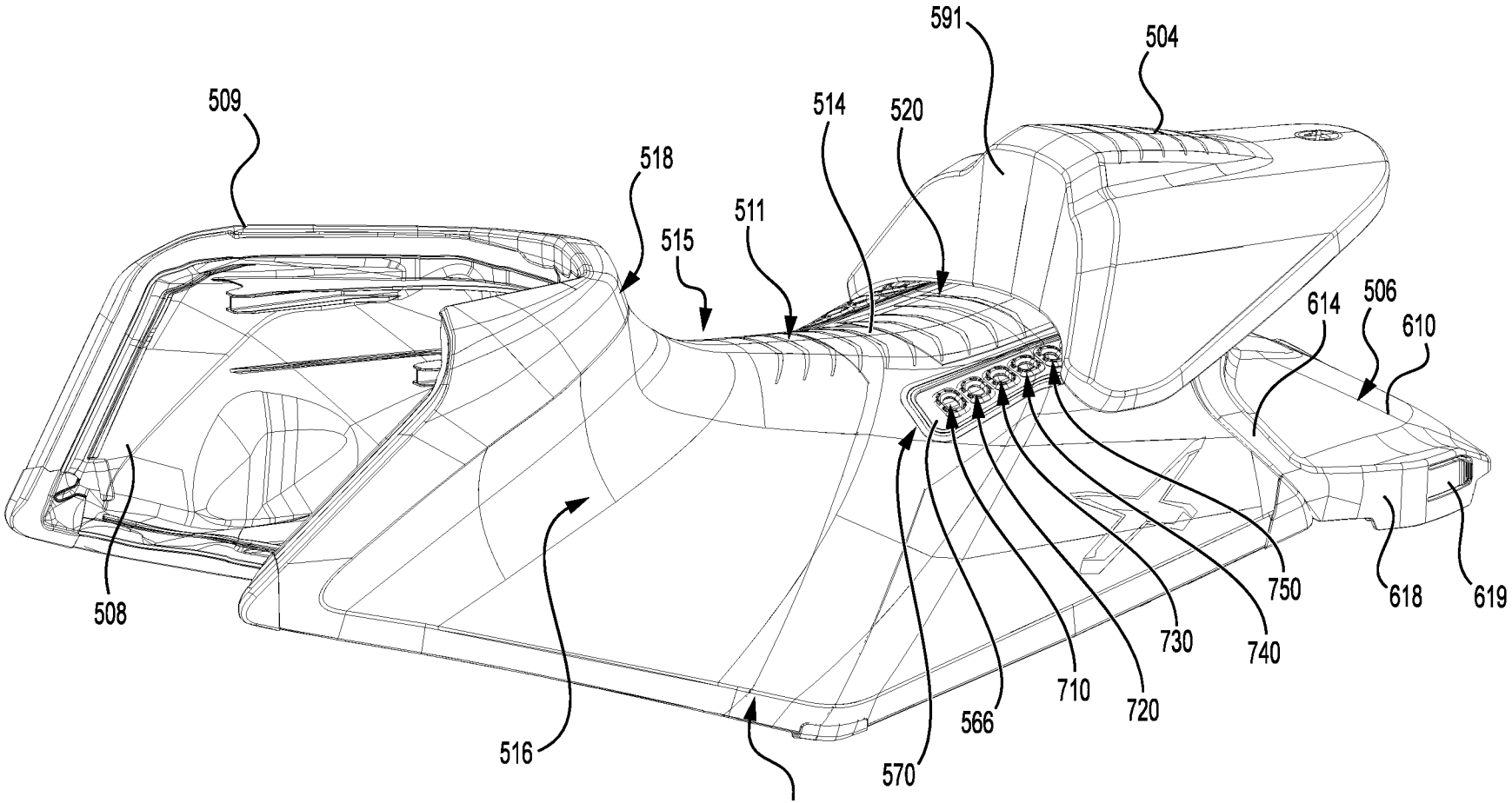
FIG. 9 is a top, front, left side perspective view of the straddle seat assembly of FIG. 3, with the backrest being at its most rearward position.
Figure 10:
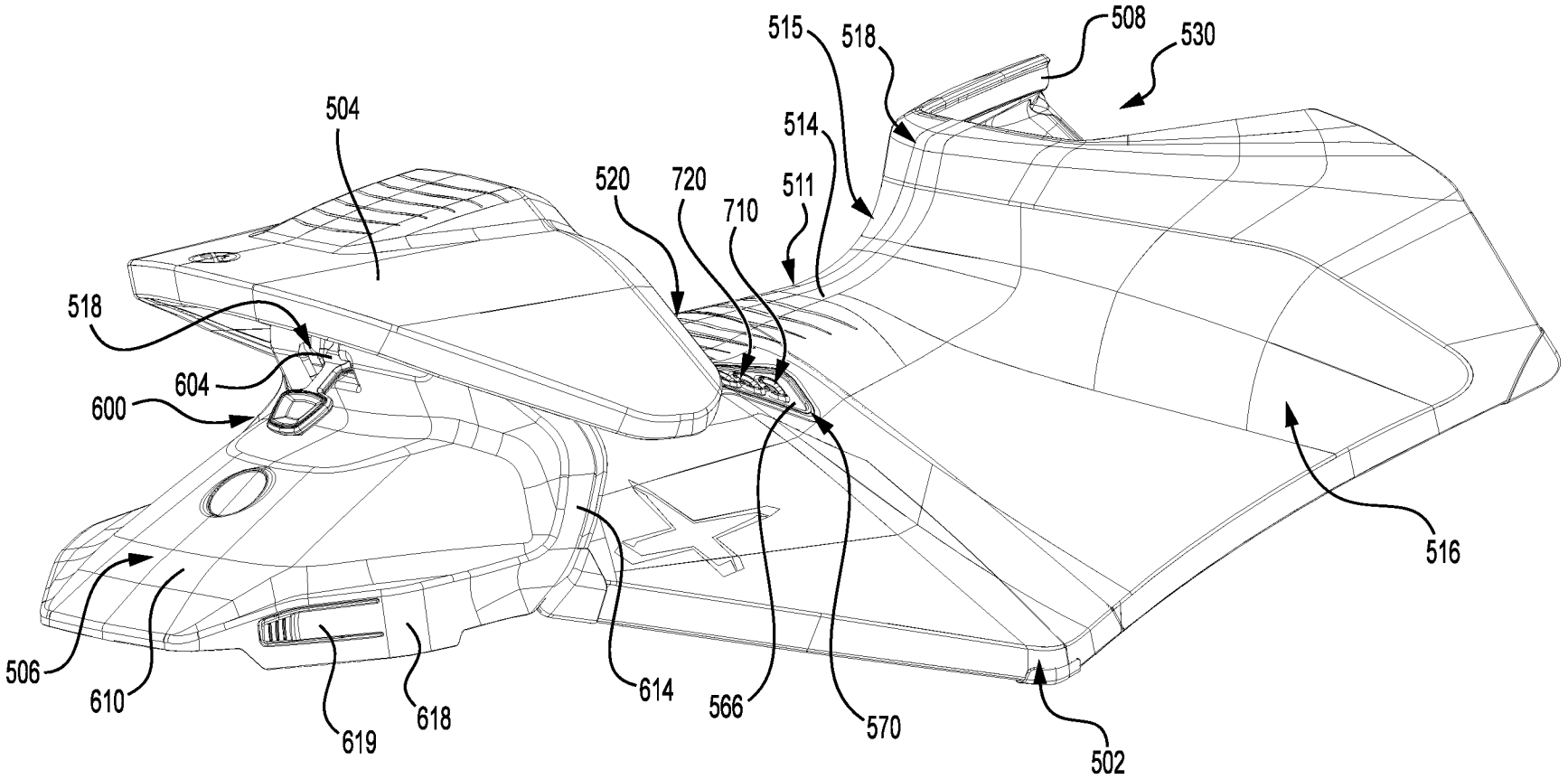
FIG. 10 is a top, rear, right side perspective view of the straddle seat assembly of FIG. 9.

As explained above, the backrest 504 is selectively placed at one of the six positions by inserting the left and right hooks 534 into one set of left and right apertures 710, 720, 730, 740, 750, 760 that correspond to a desired position. FIGS. 7 and 8 show the backrest 504 connected to the resiliently deformable top portion 511 in the first position, that is to say the hooks 534 are received in the forwardmost apertures 710. FIGS. 9 and 10 show the backrest 504 connected to the resiliently deformable top portion 511 in the sixth position, that is to say the hooks 534 are received in the rearmost apertures 760. As one can observe, the backrest 504 is longitudinally displaced from FIG. 7 to FIG. 9, and this displacement could be useful to enhance riding experience for the driver.

In the present embodiment, the left and right connection members 534 are received in the apertures 710, 720, 730, 740, 750, 760 defined in straps 550 (shown in dotted lines in FIGS. 12 and 13) when the backrest 504 is connected to the straddle seat 502. The purpose of the straps 550 is to withstand the longitudinal load applied to the backrest 504 by the driver. The straps 550 have forward portions 556 connected to a base structure 508 of the straddle seat 502, at positions forward of the apertures 710, 720, 730, 740, 750, 760. It is contemplated that in other embodiments, the straps 550 could be connected to the base structure 508 in any way that the longitudinal load is withstood by the straps 550. It is contemplated that in some embodiments, the straps 550 could be omitted. In such embodiments, the apertures 710, 720, 730, 740, 750, 760 are defined in a cover 509 and/or in a compressible layer 510, which will be described in greater detail below along with the straps 550.

Figure 6:
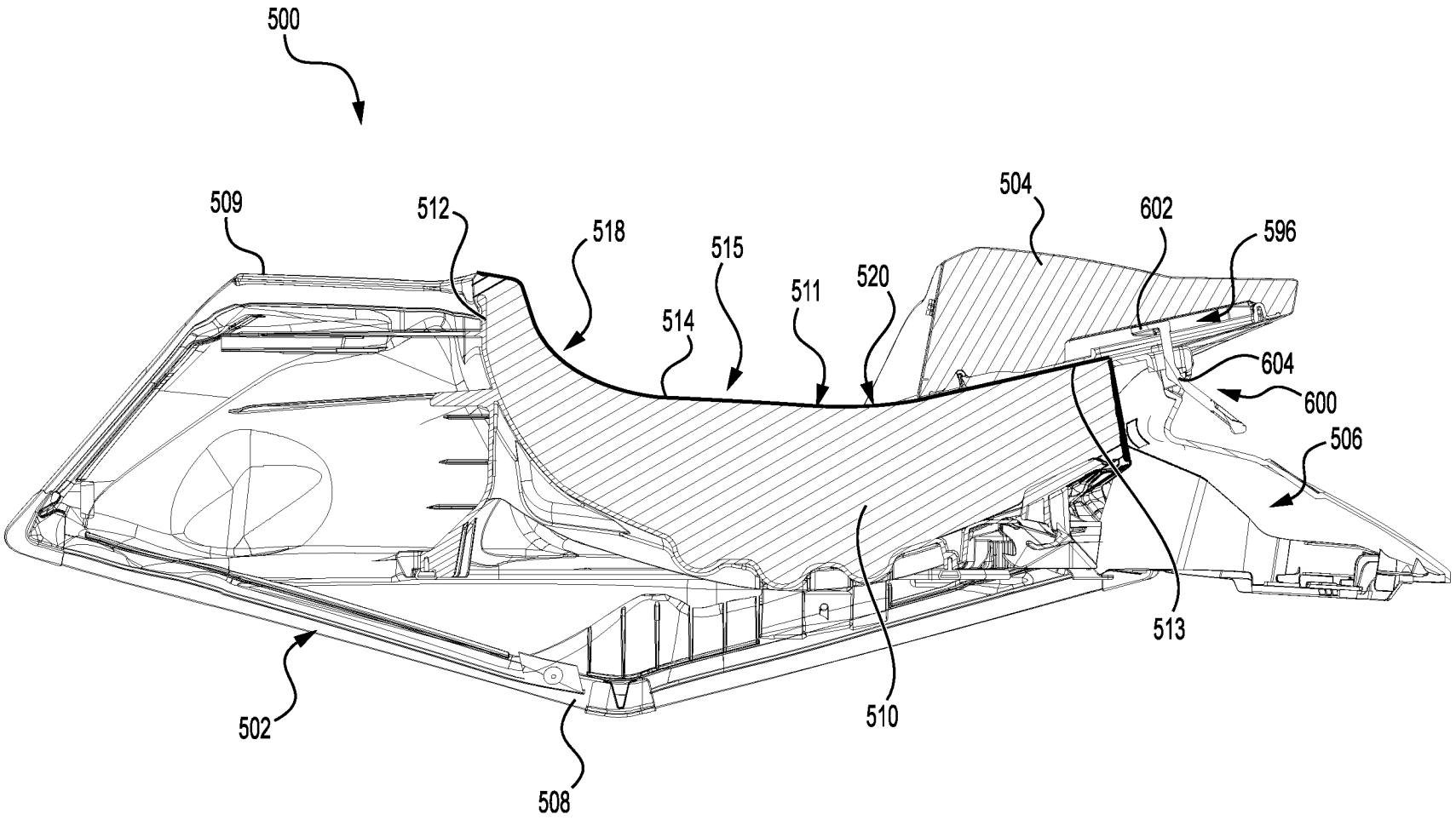
FIG. 6 is a cross-sectional view of the straddle seat assembly of FIG. 3 taken through line 6-6 of FIG. 4.

Referring to FIG. 6, the straddle seat assembly 500 also includes the rear panel 506. The backrest 504 is selectively connected to the rear panel 506 through a latch 600. It is contemplated that the backrest 504 could be connected to the rear panel 506 by other methods. It is contemplated that the backrest 504 could not be connected to the rear panel 506 and only be connected to the straddle seat 502. The backrest 504 is connected to the rear panel 506 to further secure the connection between the backrest 504 and the resiliently deformable top portion 511. A longitudinal latch slot 596 is defined on an underside 592 of the backrest 504. A portion 602 of the latch 600 is adapted to slide in the latch slot 596. The latch 600 is also connected to the rear panel 506 through a resilient latch portion 604 that is received in a latch recess 622 that is defined on the rear panel 506. When the position of the backrest 504 is changed from one position to another one of the six positions, the portion 602 can be repositioned, by sliding in the latch slot 596, to secure the backrest 504 in its new position. Once the latch 600 is appropriately positioned within the latch slot 596, the latch portion 604 is pulled downwards to where it can be received in the latch recess 622. In alternate embodiments, it is contemplated that the rear panel 506 could be replaced by a rear seat for seating one or more passengers. In alternate embodiments, it is contemplated that an adjustable backrest 504 could be provided for a passenger instead or in addition to the adjustable backrest 504 for the driver.

Referring now to FIGS. 6 to 15, the straddle seat 502 of the straddle seat assembly 500 will be described in more detail. As described above, the straddle seat assembly 500 is removably attachable to the pedestal 78 and the backrest 504 is selectively connected to the straddle seat 502.

Figure 12:
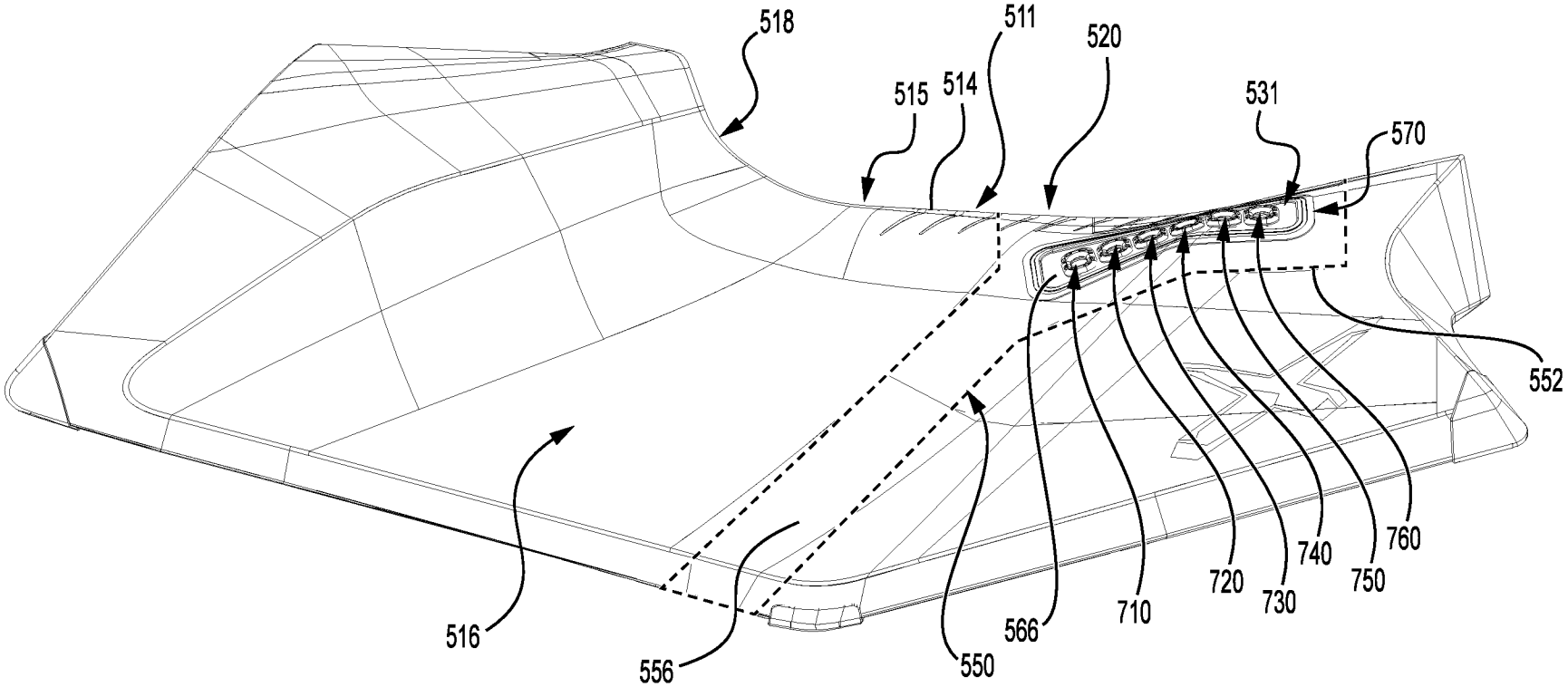
FIG. 12 is a left side elevation view of the straddle seat of the straddle seat assembly of FIG. 11 with straps of the straddle seat being shown in dotted lines.
Figure 13:
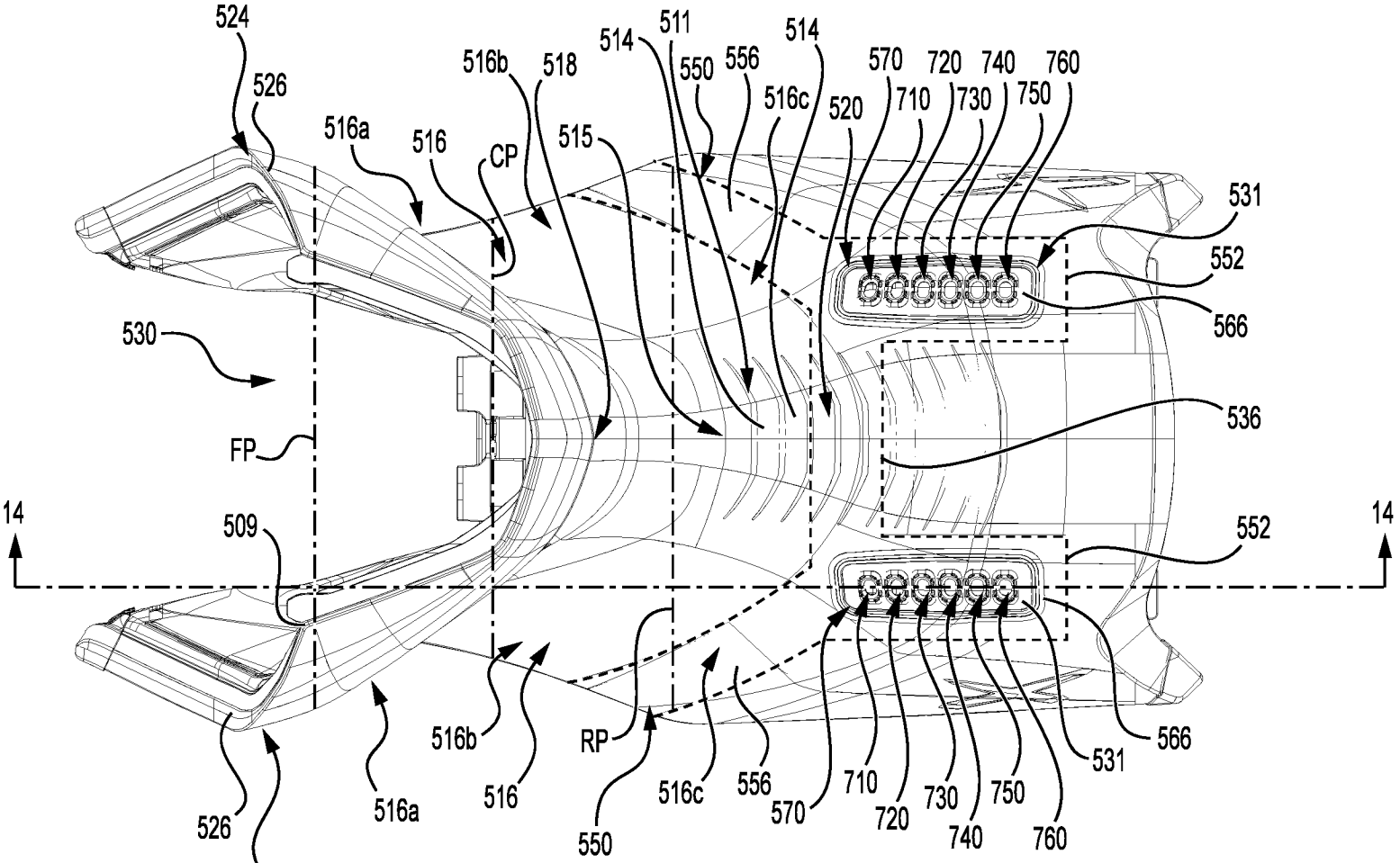
FIG. 13 is top plan view of the straddle seat of FIG. 12.

The straddle seat 502 includes the base structure 508, which has an upper surface 512 to which the resiliently deformable top portion 511 is connected. The base structure 508 is effectively rigid. With reference to FIG. 6, the resiliently deformable top portion 511 includes the compressible layer 510, a waterproof layer 513, and the cover 509. The cover 509 could, for example, be made of vinyl. As shown in FIGS. 12 and 13, the resiliently deformable top portion 511 also includes the straps 550. In some embodiments, the waterproof layer 513 could be omitted. In some embodiments, the cover 509 could be waterproof. The compressible layer 510 fully covers the upper surface 512 of the base structure 508. In some embodiments, the compressible layer 510 could only cover a certain portion of the upper surface 512. The straps 550 extend over the compressible layer 510. The waterproof layer 513 extends over the straps 550 and the compressible layer 510. The cover 509 extends over the waterproof layer 513, the straps 550 and the compressible layers 510. In other embodiments, the layering of the cover 509, the waterproof layer 513, the straps 550 and the compressible layer 510 could be different. For instance, in some embodiments, the straps 550 could be the outermost component of the straddle seat 502. It is contemplated that in some embodiments, the straps 550 could be integrated directly into the cover 509 by providing a cover 509 that is strong enough at least in some areas to resist the longitudinal loads imparted by the backrest. It is also contemplated the way each of the cover 509, the waterproof layer 513, the straps 550 and the compressible layer 510 extend about one another could be different. For instance, the waterproof layer 513 may only extend over the straps 550, rather than extending over the whole compressible layer 510. In some embodiments, the waterproof layer 513 could extend only beneath stitching areas of the cover 509. The compressible layer 510 is made of foam, but it is contemplated that in alternate embodiments, other suitable compressible material could be used. It is also contemplated that in some embodiments, the cover 509 and the compressible layer 510 could be replaced by a self-skin foam.

The foam, from which the compressible layer 510 is made, is flexible and resilient, for example having a surface hardness of IFD of between 750 N and around 1200 N. The term 'IFD' relates to Indentation Force Deflection (IFD) which is defined by ANSI/ASTM D3574-77 standard method of testing flexible cellular materials. It is also contemplated that the compressible layer 510 could be made of different types of materials providing a flexible surface.

The straddle seat 502 has a seating section 515 located at least in part rearwardly of the helm assembly 70 to accommodate the driver. The straddle seat 502 is designed for a single driver.

Figure 4:
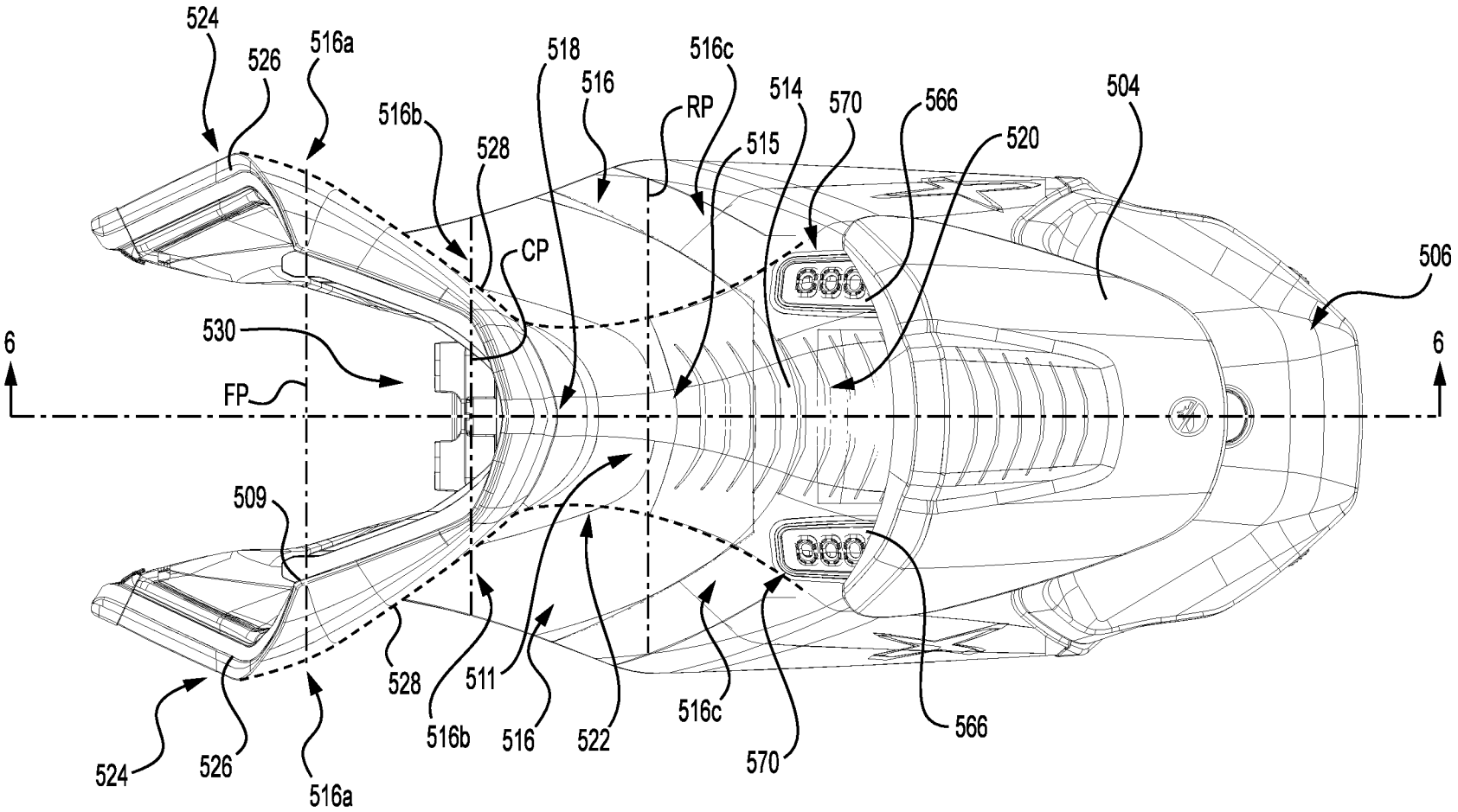
FIG. 4 is a top plan view of the straddle seat assembly of FIG. 3.
Figure 5:
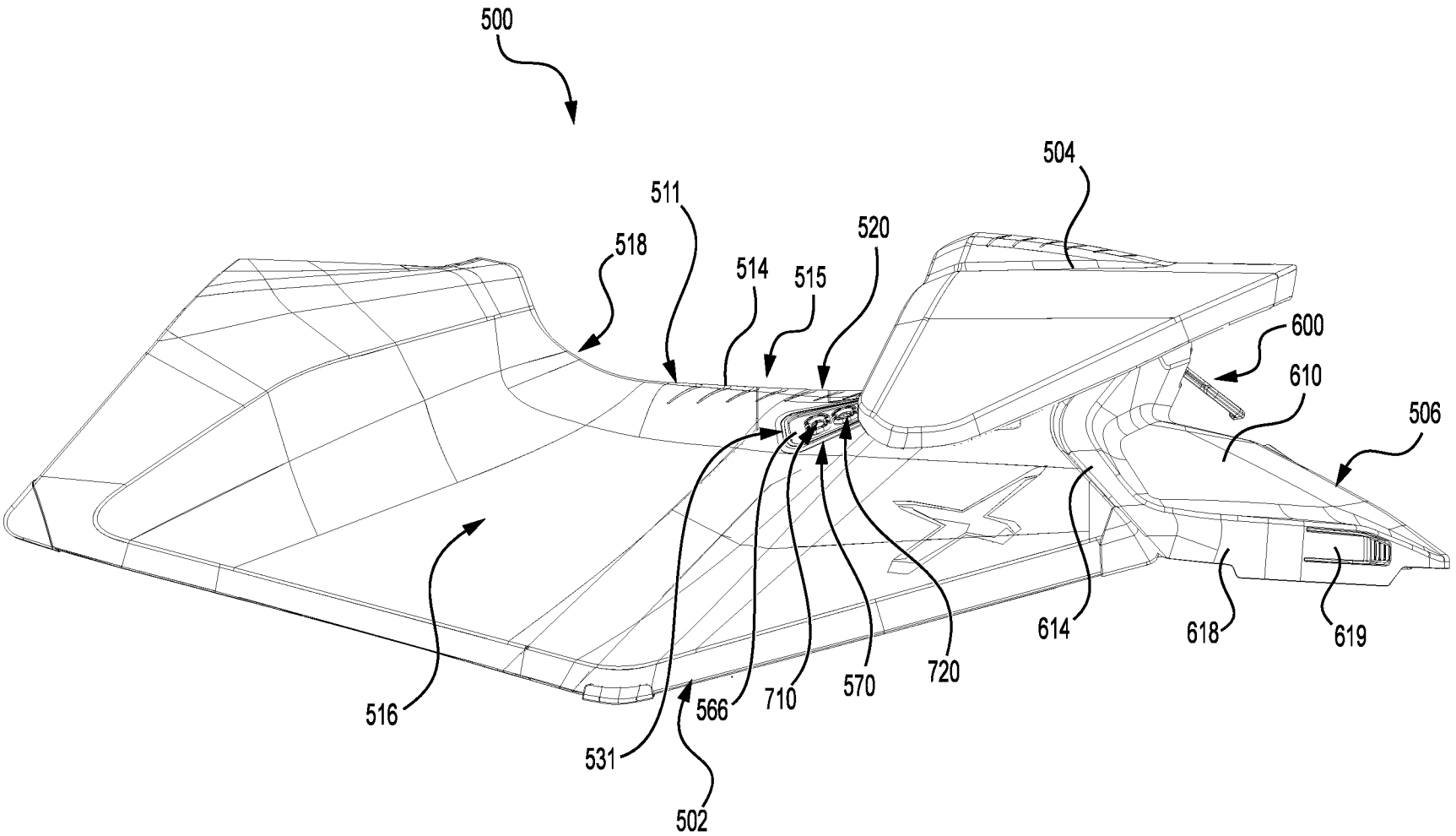
FIG. 5 is a left side elevation view of the straddle seat assembly of FIG. 3.

The seating section 515 has an upper portion 514 and two side portions 516 extending downwardly from the upper portion 514. The upper portion 514 has a front portion 518 and a rear portion 520. The rear portion 520 is adapted to receive buttocks of the driver. The front portion 518 and the rear portion 520 form a continuous profile on the upper portion 514. The front portion 518 is generally planar and extends generally upwardly and forwardly. It is contemplated that the rear portion 520 could extend more significantly upwardly from the front portion 206. As seen in FIG. 4, the front portion 518 is hourglass shaped and has a narrowing 522. The narrowing 522 is located at about the mid-length of the upper portion 514. It is contemplated that the narrowing 522 could be located elsewhere in the upper portion 514.

Referring to FIG. 4, the front portion 518 of the upper portion 514 has a pair of lateral wings 524 in the front portion 518 of the straddle seat 502 extending at least partially above the two side portions 516. The pair of lateral wings 524 has front wing portions 526 extending above and laterally outwardly beyond the two side portions 516. The front wing portions 526 correspond to a part of the lateral wings 524 located above a front side portion of the side portions 516. The rear wing portions 528 extend laterally outwardly above a central side portion of the two side portions 516. The front wing portions 526 generally cover portions of knees and at least in part thighs of the driver when the driver straddles the straddle seat 502, while the rear wing portions 528 generally cover a smaller portion of the thighs of the driver than the front wing portions 526. The driver typically uses the pair of lateral wings 524 as knee braces to transfer forces toward its lower body. The pair of lateral wings 524 also allows the driver to instinctively find its knee and thighs position on the straddle seat 502 in preparation for sharp turns. Finally, the pair of lateral wings 524 also partially restrains the entire body from sliding off the watercraft 50 via an upward translation during operating conditions of high lateral forces as in buoy course.

Figure 15B:
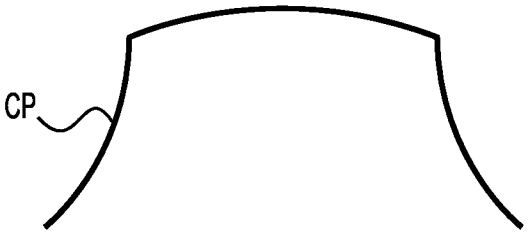
FIG. 15B is a profile of an outer surface of the straddle seat of FIG. 13 taken along line CP in FIG. 13.
Figure 15C:
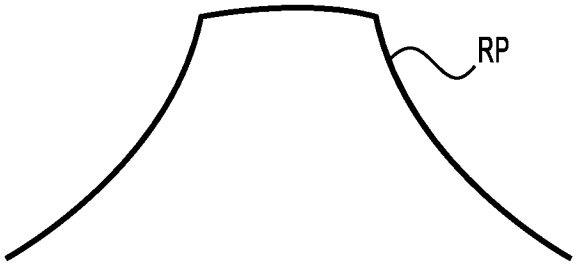
FIG. 15C is a profile of an outer surface of the straddle seat of FIG. 13 taken along line RP in FIG. 13.
Figure 15A:
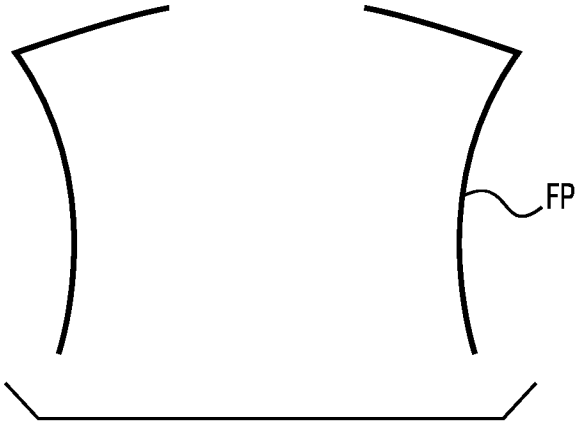
FIG. 15A is a profile of an outer surface of the straddle seat of FIG. 12 taken along line FP in FIG. 13.

The two side portions 516 extend outwardly from the upper portion 514. Each of the two side portions 516 has a front side portion **516*a* underneath the front wing portion 526, a central side portion 516*b* underneath the rear wing portion 528, and a rear side portion 516*c* located rearwardly of the rear wing portion 528. FIG. 4 shows the portions 516*a*, 516*b* and 516*c*. The side portions 516*a*, 516*b* and 516*c* have different outer surface profiles. As seen in FIG. 15A, an outer surface of the front side portion 516*a* has a generally concave profile FP. As seen in FIG. 15B, an outer surface of the central side portion 516*b* has a profile CP that is extending generally outwardly from the upper portion 514. As seen in FIG. 15C, an outer surface of the rear side portion 516*c* has a profile RP that is extending generally outwardly from the upper portion 514. The profile CP is more concave than the profile RP so as to transition between the concave profile FP and the profile RP. The concave shape of the front side portion 516*a* creates a depression in which the driver can abut his/her knees and locate them under the lateral wings 524 when straddling the straddle seat 502**.

A recess 530 is defined in the front portion 518 of the upper portion 514 between the pair of lateral wings 524. The recess 530 is sized to accommodate the helm assembly 70.

It is contemplated that in some embodiments, the lateral wings 524 of the straddle seat 502 could be omitted. In other embodiments, the profile of the outer surface could be different.

Referring to FIGS. 12, 13, 16 and 17, the straps 550 will be further described. The straps 550 are shown in FIGS. 12 and 13 by dotted lines as they are located under the cover 509. There are two straps 550 that laterally spaced. The straps 550 each have a rear portion 552. The rear portions 552 each define the apertures 710, 720, 730, 740, 750, 760. A laterally extending intermediate strap portion 536 disposed laterally between the two straps 550 connects the two straps 550 to each other. In some embodiments, the intermediate strap portion 536 could be omitted. In other embodiments, the straps 550 could be replaced by a single laterally centered strap. It is contemplated that more than two straps 550 could be provided. The straps 550 also each have a forward portion 556. The forward portions 556 are riveted to a lower edge of the base structure 508 ahead of the apertures 710, 720, 730, 740, 750, 760. It is contemplated that the forward portions 556 could be connected to base structure 508 by other methods such as adhesive, clamping, bolting, etc. In the present embodiment, a portion of the forward portions 556 of the straps 550 extend from the rear portion 520 of the straddle seat 502 to the central side portions **516*b*, below the region where the driver's thigh would be located. In other embodiments, the forward portions 556** of the straps 550 could connect to the front portion 518 of the straddle seat 502 without extending through the central side portions 516*b*.

As explained above, the straps 550 are connected to the base structure 508 ahead of the pairs of apertures 710, 720, 730, 740, 750, 760 and take the longitudinal loads applied on the backrest 504 by the driver so that the cover 509 does not have to. In some embodiments, the straps 550 could extend longitudinally through the compressible layer 510. In other embodiments, the straps 550 could connect rearward of the apertures 710, 720, 730, 740, 750, 760, by wrapping around the straddle seat 502 from the front portion 518 to the rear portion 520. Also, the straps 550 are not significantly extendible. As such, when the longitudinal load is applied in the rearward direction to the straps 550, the straps 550 do not extend but rather withstand the tensile forces they are subjected to, to keep the backrest 504 securely connected.

The straps 550 do not significantly extend when in tension but are nonetheless flexible, and as such, the straps 550 conform to the shape of the resiliently deformable top portion 511 of the straddle seat 502, even when the resiliently deformable top portion 511 is deformed. As such, when a wave impacts the bow 56 of the watercraft 50 and the resiliently deformable top portion 511 compresses, the backrest 504 moves with the cover 509.

Figure 14:
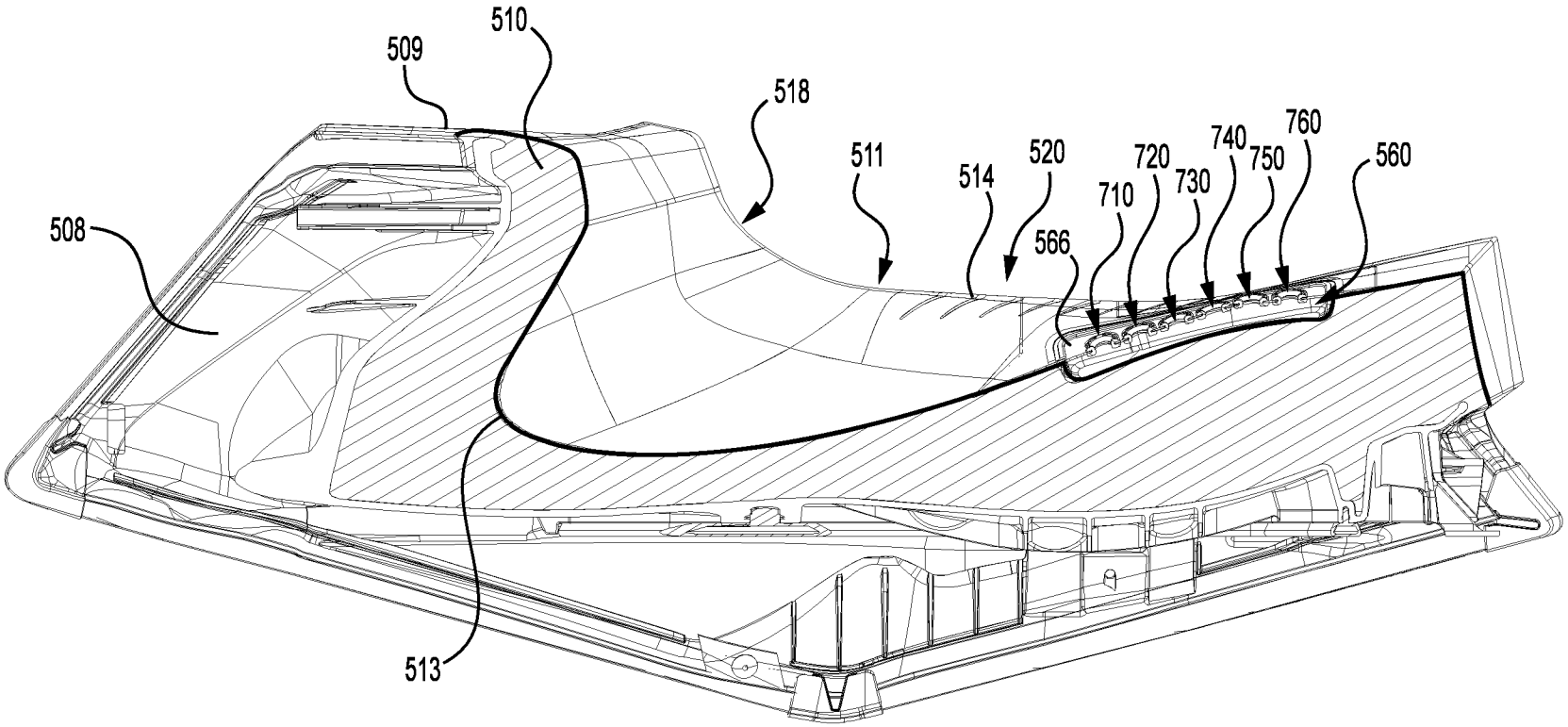
FIG. 14 is a cross-sectional view of the straddle seat of FIG. 12 taken through line 14-14 of FIG. 13.
Figure 17:
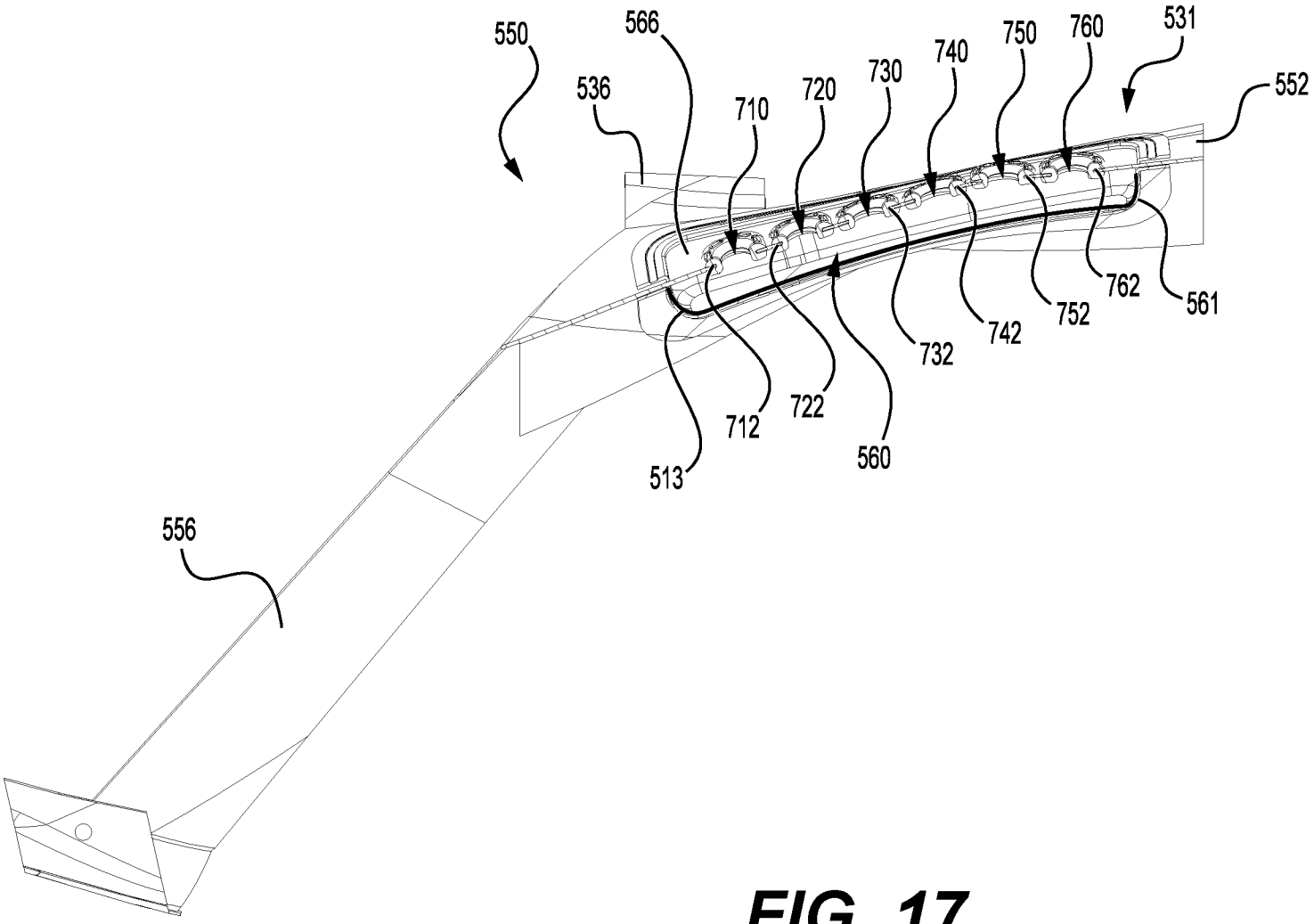
FIG. 17 is a cross-sectional view of the straps of FIG. 12 taken through line 17-17 of FIG. 16.

Referring to FIGS. 14 and 17, left and right pockets 560 are defined in the compressible layer 510 under the straps 550. The left and right pockets 560 are defined below the apertures 710, 720, 730, 740, 750, 760. It is contemplated that in some embodiments, each aperture 710, 720, 730, 740, 750, 760 could have its own distinct pocket. The left and right pockets 560 provide clearance for the left and right hooks 534 to pivot into a stable position upon entering the apertures 710, 720, 730, 740, 750, 760. The left and right pockets 560 are partly defined by walls 561. The walls 561 have a waterproof layer 513 (shown in FIG. 14). The waterproof layer 513 prevents water that has reached into the left and right pockets 560 to further reach the compressible layer 510. In some embodiments, the walls 561 could have a protective layer covering the waterproof layer 513. The protective layer could prevent the left and right hooks 534 from damaging the waterproof layer 513 and or the compressible layer 510.

Water could reach into the left and right pockets 560. The water accumulates in the left and right pockets 560, and eventually evaporates. It is contemplated that in some embodiments, the left and right pockets 560 could be fluidly connected to drains to allow the water to exit the left and right pockets 560.

Figure 16:
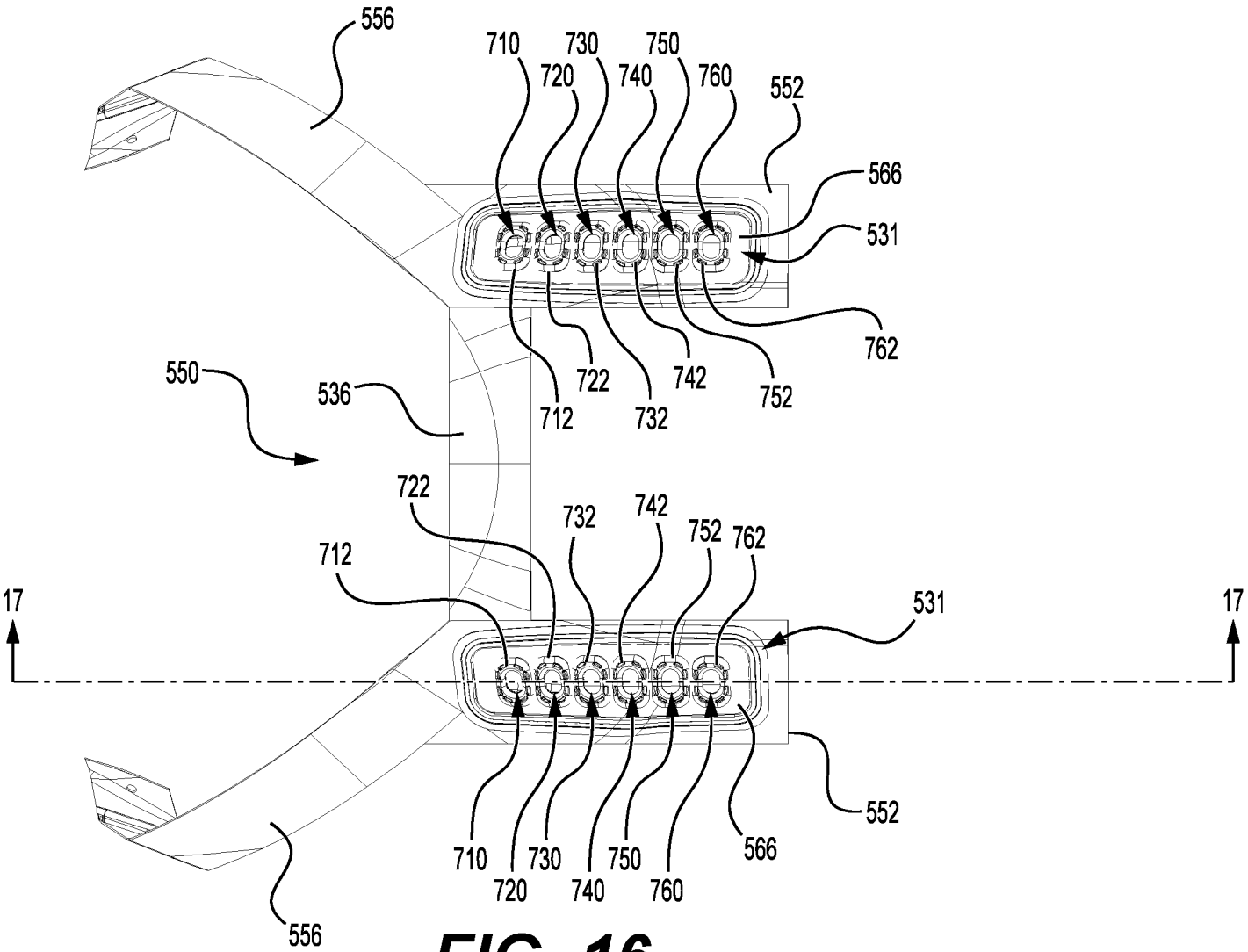
FIG. 16 is top plan view of the straps of FIG. 12.

With reference to FIGS. 16 and 17, the straddle seat assembly 500 has a first pair of eyelets 712 disposed in the first pair of apertures 710, a second pair of eyelets 722 disposed in the second pair of apertures 720, a third pair of eyelets 732 disposed in the third pair of apertures 730, a fourth pair of eyelets 742 disposed in the fourth pair of apertures 740, a fifth pair of eyelets 752 disposed in the fifth pair of apertures 750 and a sixth pair of eyelets 762 disposed in the sixth pair of apertures 760.

It is contemplated that in other embodiments having a different number of apertures 710, 720, 730, 740, 750, 760, there would be a corresponding number of eyelets 712, 722, 732, 742, 752, 762. It is also contemplated that in some embodiments, the eyelets 712, 722, 732, 742, 752, 762 could be omitted. The eyelets 712, 722, 732, 742, 752, 762 are made of a relatively rigid material, such as a rigid plastic. It is contemplated that in other embodiments, the eyelets 712, 722, 732, 742, 752, 762 could be made from flexible material. The eyelets 712, 722, 732, 742, 752, 762 provide a layer of protection again shearing and other damages to the straps 550 from the backrest 504 and the left and right connection members 534.

The cover 509 defines left and right cover apertures 570. The left and right cover apertures 570 are defined to respectively surround left and right set of apertures 710, 720, 730, 740, 750, 760. The straddle seat assembly 500 also includes left and right gaskets 566. The left and right gaskets 566 are placed between the straps 550 and the cover 509. The left and right gaskets 566 surround the apertures 710, 720, 730, 740, 750, 760 and the left and right cover apertures 570. The left and right gaskets 566 help prevent water from entering under the cover 509 by the cover apertures 570. It is contemplated that the gaskets 566 could be omitted.

Figure 11:
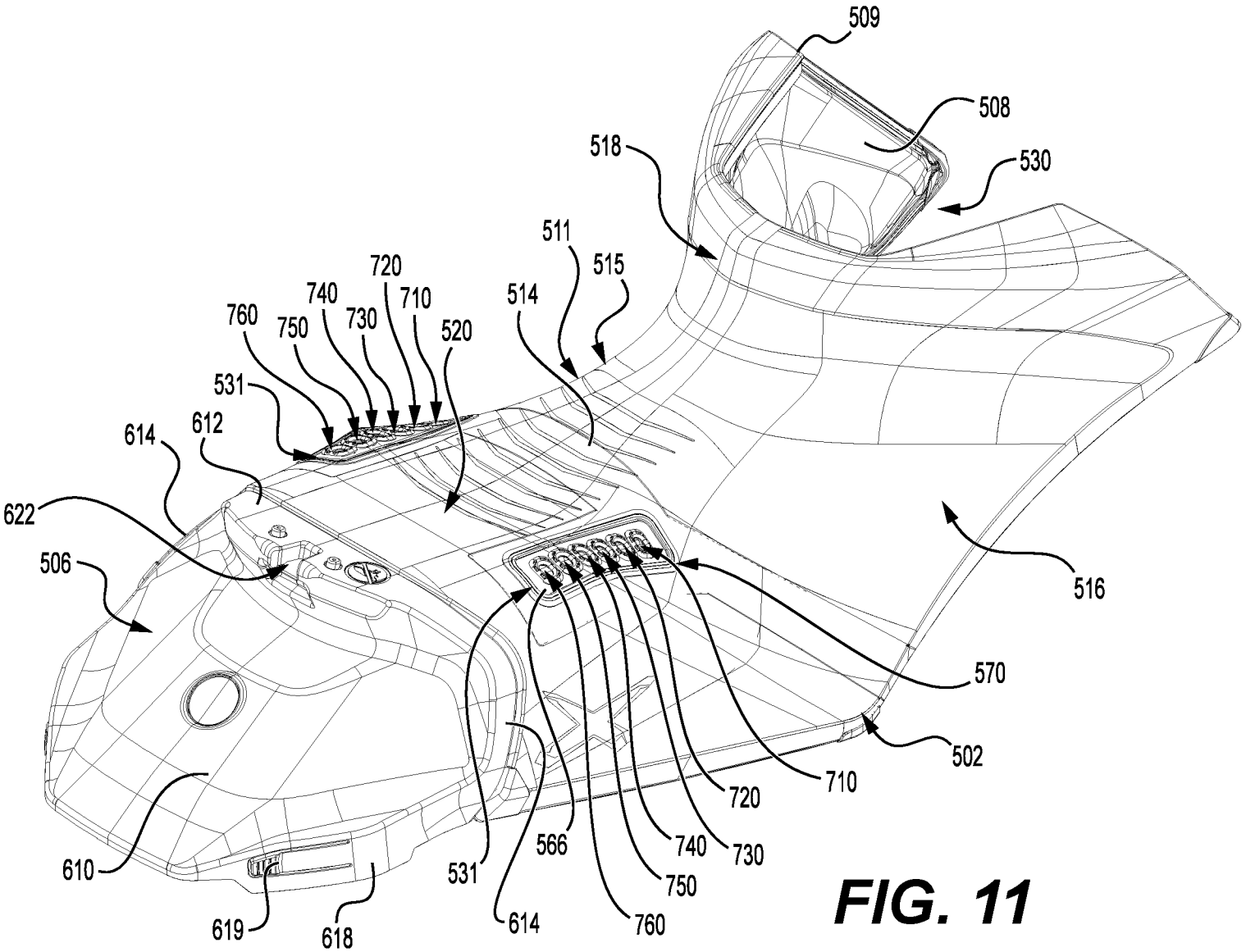
FIG. 11 is a top, right, rear side perspective view of a straddle seat and a rear panel of the straddle seat assembly of FIG. 3.

Referring now to FIG. 11, the rear panel 506 will be further described. As described above, the rear panel 506 connects to the straddle seat 502 and to the deck 54 of the watercraft 50. The rear panel 506 has an outer recessed portion 610. The outer recessed portion 610 is surrounded by a top portion 612, left and right portions 614, bottom left and right portion 618. The top portion 612, the left and right portions 614 are flush with the rear portion 520 of the straddle seat 502. The latch recess 622 of the rear panel 506 is defined in the top portion 612.

The rear panel 506 also has left and right push buttons 619 on the left and right bottom portions 618. The left and right push bottoms 619 are used to disconnect the straddle seat 502 as disclosed in U.S. Pat. No. 10,214,270.

As described above, the latch 600 connects the backrest 504 to the rear panel 506. The latch 600 is connected to the rear panel 506 thanks to the portion 604 that is connected to the latch recess 622. The latch 600 could be removed from the rear panel 506 when desired.

The portion 602 of the latch 600 is adapted to slide in the latch slot 596. As such, when the backrest 504 is moved to a new position, the portion 602 of the latch 600 is free to be repositioned to secure the backrest 504 to the rear panel 506 in its new position.

As can be seen in FIGS. 20 and 21, the latch slot 596 is defined near the rear end of the underside 592, and the latch slot 596 extends in the longitudinal direction. The latch slot 596 is adapted for receiving the portion 602 of the latch 600. The latch slot 596, on its upper surface has a gasket and a protective layer (neither of which are shown) to prevent water entry and prevent the latch from damaging the upper surface of the latch slot 596. It is contemplated that in other embodiments, the gasket and the protective layer may be omitted.

Referring now to FIGS. 18 to 21, the backrest 504 will be described in more detail. The backrest 504 has a backrest portion 505 and the left and right connection members 534.

As described above, the left and right connection members 534 are hooks 534. As such, the hooks 534 are inserted into one pair of the apertures 710, 720, 730, 740, 750, 760 by pivoting the hooks 534 into that pair of the apertures 710, 720, 730, 740, 750, 760. The hooks 534 and the apertures 710, 720, 730, 740, 750, 760 of the illustrated embodiment are sized and shaped such that the former cannot be removed from the latter without a significant effort on the part of the operator. As such, the backrest 504 will not accidentally detach from the straddle seat 502, even without use of the latch 600

Figure 18:
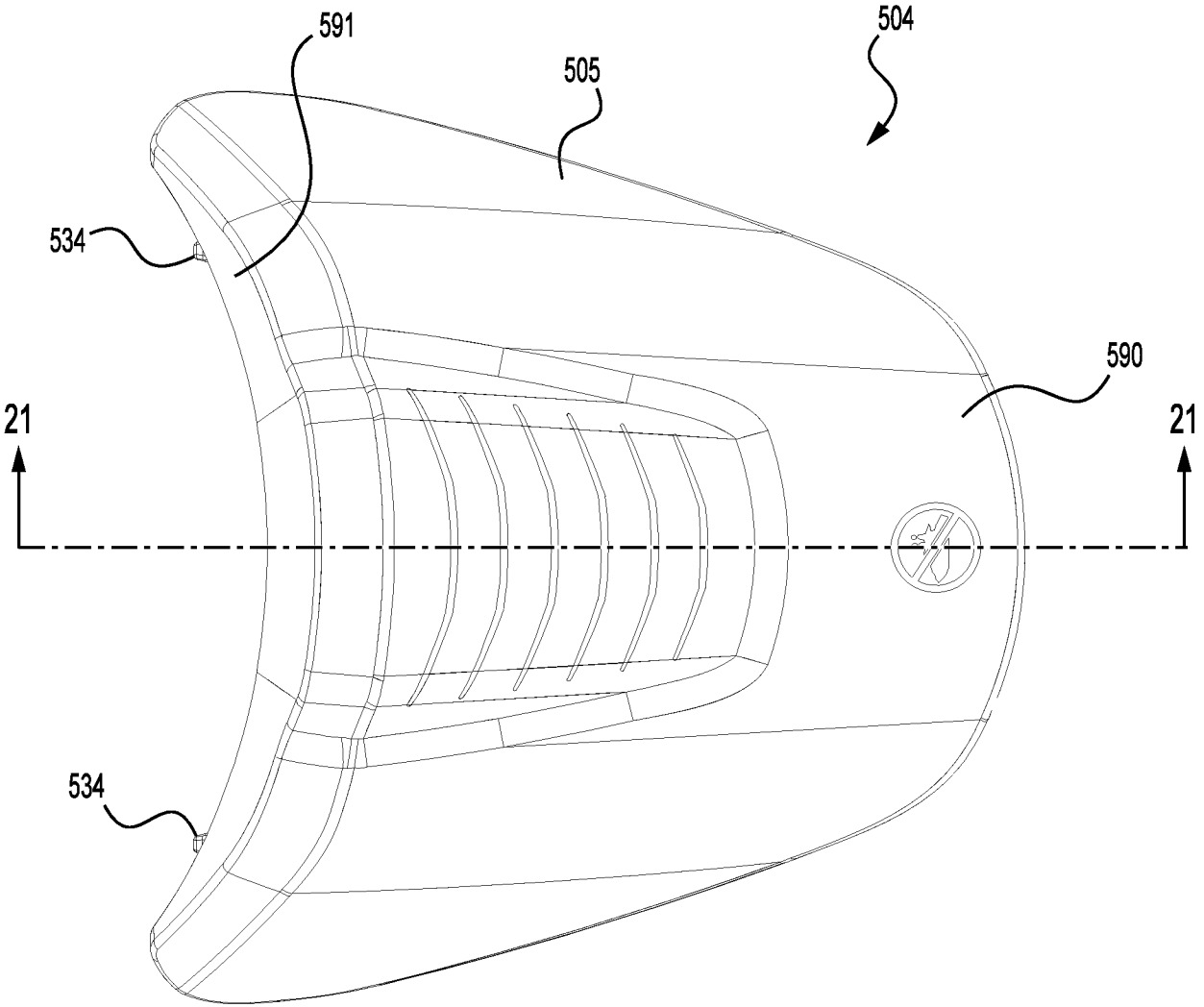
FIG. 18 is a top plan view of the backrest of the straddle seat assembly of FIG. 3.

The backrest portion 505 has a forward surface 591 (best seen in FIGS. 7 and 18). The forward surface 591 is concave, and extends laterally and slightly forward. The forward surface 591 is adapted for receiving the driver's lower back area. It is contemplated that the forward surface 591 could have another shape. The backrest portion 505 has an upper surface 590. The backrest portion 505 has the underside 592, in which the latch slot 596 is defined. The backrest portion 505 also has a bottom surface 594 that surrounds the underside 592. The bottom surface extends to the rear from the forward surface 591. The bottom surface 594 follows the shape of the straddle seat 502. Referring to FIG. 21, the backrest portion 505 has a compressible layer 597, and a cover 599 covering the compressible layer 597. The compressible layer 597 is connected to a backrest base structure 603. It is contemplated that in some embodiments, the cover 509 could be omitted.

Referring to FIG. 20, the left and right hooks 534 respectively project downwards and forwards from left and right brackets 580. The left and right brackets 580 are riveted into the bottom surface 594 of the backrest portion 505. It is contemplated that in some embodiments, the left and right brackets 580 could be connected by screws, adhesive, or other connectors. It is also contemplated that the left and right hooks 534 could be integrally formed with the backrest portion 505. It is further contemplated that the left and right hooks 534 could extend downwards and rearwards from the left and right brackets 580. It is contemplated that a plurality of forward or rearward facing hooks 534 could be provided along the underside 592 of the backrest portion 505. It is further contemplated that one or more forward or rearward facing hooks 534 could be provided along the top surface of the resiliently deformable top portion 511. It is also contemplated that a connection member other than a hook could be used, such as snaps.

Modifications and improvements to the above-described embodiment of the present technology may become apparent to those skilled in the art. The foregoing description is intended to be exemplary rather than limiting. The scope of the present technology is therefore intended to be limited solely by the scope of the appended claims.

What is claimed is:

1. A straddle seat assembly comprising:

a backrest; and a straddle seat, the straddle seat having:

a base structure, the base structure having an upper surface; and a resiliently deformable top portion connected to and covering at least partially the upper surface of the base structure, the backrest being selectively connected to the resiliently deformable top portion at either one of at least two positions along a length of the resiliently deformable top portion such that deformation of the top portion permits movement of the backrest.

2. The straddle seat assembly of claim 1, wherein:

one of the top portion and the backrest has at least two longitudinally spaced first connector portions, each of the at least two first connector portions defining a corresponding one of the at least two positions; and an other one of the top portion and the backrest has at least one second connector portion, the at least one second connector portion is connectable to the at least two first connector portions.

3. The straddle seat assembly of claim 2, wherein:

the at least two first connector portions is at least two longitudinally spaced apertures defined in the one of the top portion and the backrest; and the at least one second connector portion is at least one connection member, the at least one connection member is selectively received in one of the at least two longitudinally spaced apertures corresponding to a desired one of the at least two positions.

4. The straddle seat assembly of claim 3, wherein the top portion defines the at least two apertures and the backrest has the at least one connection member.

5. The straddle seat assembly of claim 4, wherein the backrest comprises:

a backrest portion; and the at least one connection member extending from a bottom of the backrest portion.

6. The straddle seat assembly of claim 2, wherein the top portion defines the at least two first connector portions and the backrest has the at least one second connector portion.

7. The straddle seat assembly of claim 6, wherein the top portion of the straddle seat includes at least one strap extending generally longitudinally and defining the at least two first connector portions.

8. The straddle seat assembly of claim 7, wherein:

the at least two first connector portions is at least two longitudinally spaced apertures defined in the at least one strap;

the backrest has the at least one second connector portion;

the at least one second connector portion is at least one connection member; and the at least one connection member is selectively received in one of the at least two longitudinally spaced apertures corresponding to a desired one of the at least two positions.

9. The straddle seat assembly of claim 7, wherein the at least one strap has a forward portion connected to the base.

10. The straddle seat assembly of claim 7, wherein:

the top portion of the straddle seat includes a compressible layer connected to and covering at least partially the upper surface of the base structure; and the at least one strap extends over at least a portion of the compressible layer.

11. The straddle seat assembly of claim 7, wherein a portion of the at least one strap extends in a region of the straddle seat adapted for receiving a thigh of a person sitting on the straddle seat.

12. The straddle seat assembly of claim 7, wherein:

the at least one strap is two laterally spaced straps; and the at least one second connector portion is two laterally spaced second connector portions.

13. The straddle seat assembly of claim 12, wherein the two laterally spaced straps are connected to each other by a laterally extending intermediate strap portion disposed laterally between the two straps.

14. The straddle seat assembly claim 4, further comprising at least two eyelets, each of the at least two eyelets being disposed in a corresponding one of the at least two longitudinally spaced apertures.

15. The straddle seat assembly of claim 8, wherein:

the top portion of the straddle seat includes a compressible layer connected to and covering at least partially the upper surface of the base structure;

the at least one strap extends over at least a portion of the compressible layer; and at least one pocket defined in the compressible layer, the at least two longitudinally spaced apertures being disposed above the at least one pocket.

16. The straddle seat assembly of claim 15, wherein:

the top portion of straddle seat further includes a cover covering the compressible layer;

the compressible layer being between the base structure and the cover; and the at least one strap being between the compressible layer and the cover.

17. The straddle seat assembly of claim 1, further comprising:

a rear panel connected to the straddle seat; and a latch selectively connecting the backrest to the rear panel.

18. The straddle seat assembly of claim 2, wherein the at least one second connector portion is at least one hook.

19. The straddle seat assembly of claim 1, wherein the straddle seat has:

a rear portion and a front portion, the front portion extending upwardly and forwardly from the rear portion, the front portion having a generally hourglass shape, the hourglass shape having a narrowing, the front portion having a pair of lateral wings; and two downwardly extending side portions, the pair of lateral wings extending laterally outwardly above at least part of the two side portions, the pair of lateral wings being adapted to cover at least in part knees and thighs of a rider.

20. A personal watercraft comprising:

a hull having a bow and a stern; and a deck disposed on the hull, the deck having:

a pair of footrests; and a pedestal disposed between the footrests, and a straddle seat assembly according to claim 1.

* * * * *